US006079390A

United States Patent [19]

Hashimoto et al.

[11] Patent Number: 6,079,390

[45] Date of Patent: Jun. 27, 2000

[54] THROTTLE DEVICE FOR INTERNAL COMBUSTION ENGINE

[75] Inventors: Yoshikatsu Hashimoto, Hitachioota; Shigeo Tamaki; Shigeru Tokumoto, both of Hitachinaka; Hitoshi Miwa, Oomiya-machi, all of Japan

[73] Assignee: Hitachi, Ltd., Tokyo, Japan

[21] Appl. No.: 09/417,237

[22] Filed: Oct. 12, 1999

Related U.S. Application Data

[63] Continuation of application No. 08/928,659, Sep. 12, 1997, Pat. No. 5,983,858.

[30] Foreign Application Priority Data

Sep. 12, 1997 [JP] Japan ..... 8-242136

[51] Int. Cl.[7] ..... F02D 9/00

[52] U.S. Cl. ..... 123/399; 123/396

[58] Field of Search ..... 123/396, 399, 123/337

[56] References Cited

U.S. PATENT DOCUMENTS

| | | | |
|---|---|---|---|
| 4,947,815 | 8/1990 | Peter | 123/399 |
| 5,146,887 | 9/1992 | Gluchowski et al. | 123/337 |
| 5,452,697 | 9/1995 | Sasaki et al. | 123/399 |
| 5,735,243 | 4/1998 | Asai et al. | 123/396 |
| 5,787,861 | 8/1998 | Suzuki et al. | 123/399 |
| 5,975,051 | 11/1999 | Yamada et al. | 123/399 |

FOREIGN PATENT DOCUMENTS

| | | |
|---|---|---|
| 2-500677 | of 0000 | Japan . |
| 3-271528 | of 0000 | Japan . |
| 4-203219 | of 0000 | Japan . |

*Primary Examiner*—Erick R. Solis
*Attorney, Agent, or Firm*—Evenson, McKeown, Edwards & Lenahan, P.L.L.C.

[57] ABSTRACT

In an initial opening degree setting mechanism which keeps an initial opening degree of a throttle valve (24) larger than that of a fully closed position thereof when no current is supplied to a motor (12) for driving a throttle shaft (18) for the throttle valve (24), a throttle lever (3) and a sleeve (45) are inserted into the throttle shaft (18) and secured thereto and a sleeve (42) integrated with a return lever (2) is fitted over the sleeve (45) so as to permit a relative rotational mevement with respect to the sleeve (45). The sleeve (42) is urged by a return spring (4) in the direction of closing the throttle valve (24) upto the position of the initial opening degree. With the urging force the return lever (2) is placed to be engageable with the throttle lever (3). The throttle shaft (18) is applied of a valve opening force by a spring for keeping the initial opening degree of the throttle valve (24) near the fully closed position thereof, thereby parts belonging to the throttle valve initial opening degree setting mechanism are collectively and rationally arranged, a driving load of the throttle actuator motor (12) is reduced and a throttle valve control operation is stabilized.

1 Claim, 16 Drawing Sheets

| | θ1 | θ2 | θ3 |
|---|---|---|---|
| SETVALUE | 30° | 5° | 7° |
| | | | |

THROTTLE DEVICE FOR INTERNAL COMBUSTION ENGINE

This application is a continuation of application Ser. No. 08/928,659, filed Sep. 12, 1997, now U.S. Pat. No. 5,983, 858.

BACKGROUND OF THE INVENTION

1. Field of the invention

The present invention relates to a throttle device for an internal combustion engine which performs an opening degree control of a throttle valve for the internal combustion engine with an electrical actuator and, more specifically, to a throttle device for an internal combustion engine with a mechanism in which an initial opening degree of a throttle valve for the internal combustion engine, when an engine key switch is turned off, is set larger than that of a fully closed position of the throttle valve.

2. Description of Conventional Art

In conventional electric throttle control schemes in which a throttle valve for an internal combustion engine is driven and controlled by an electrical actuator, it was proposed to set larger an initial opening degree of the throttle valve (hereinbelow also called as a throttle initial opening degree), when an engine key switch is turned off, in other words when no current is supplied to a motor for the throttle actuator, than that of fully closed position of the throttle valve which corresponds to an opening degree for a normal idling operation after completing a warming-up operation.

One of reasons of setting the initial opening degree as such is to ensure a necessary air flow rate for combustion in a prior warming-up operation during engine starting, in other words in a cold climate starting. Further, during an idling operation a control is performed in which depending on an advancement of the warming-up operation the opening degree of the throttle valve is gradually restricted from the initial opening degree to that of the fully closed position which corresponds to an opening for a normal idling operation.

Other reasons of setting the initial opening degree as such are to ensure self pulling for permitting a limp home function in case when a throttle control system malfunctions, to ensure a predetermined air flow rate for preventing a possible engine stop and to prevent the throttle valve from adhering to the inner wall of a throttle body by such as adhering material and ice pieces contained in the air.

For example, JP(PCT)-A-2-500677 discloses a return spring serving as a first urging means which urges a throttle valve in its closing direction and a resisting spring serving as a second urging means or a spring used for determining an initial opening degree which urges the throttle valve in its opening direction against the return spring wherein the spring force of the resisting spring of the latter at the position of the throttle initial opening degree is set larger than that of the return spring and during an engine key switch being turned off a free end of the resisting spring is engageably stopped by a stopper at the position of the throttle valve initial opening degree so as to hold the throttle initial opening degree.

Further, JP-A-3-271528 discloses the following structure in which a sleeve serving as a supporting member as well as one of constituting elements for a relief lever is fitted in a boss portion on a side wall of a throttle body where an end of a throttle shaft is supported so as to permit free movement in a rotating direction, the relief lever is urged by a return spring serving as a first urging means in the direction for closing the throttle valve, on one hand, a throttle lever is secured to the throttle shaft and the relief lever is then engaged to the throttle lever by the spring force of the return spring, and during no current being supplied to a motor the throttle valve is moved through the engagement of the relief lever and the throttle lever and through the spring force of the return spring upto a predetermined position where the opening degree of the throttle valve is larger than that at the fully closed position thereof and is stopped there by a stopper and at this predetermined position the throttle lever is urged in the direction of opening the throttle valve by making use of a second urging means to thereby hold a throttle initial opening degree.

Still further, JP-A-4-203219 discloses a structure in which a lever is secured at an end of a throttle shaft so as to cross therewith, a return spring serving as a first urging means applies an urging force to one end of the lever in the direction of closing the throttle valve, a second urging means applies an urging force to the other end of the lever in the direction of opening the throttle valve near a throttle fully closed position, and the urging force of the second urging means is set larger than that of the first urging means when a throttle opening degree is below a predetermined opening degree, in that below the throttle initial opening degree to thereby maintain the throttle initial opening degree.

In these conventional examples, controls of the throttle valve opening degree are performed through drive controls of their motors based on control signals transmitted from their control systems and when a throttle valve opening degree is desired to be reduced less than the throttle initial opening degree, a driving torque by the motor is effected to move the throttle valve in the closing direction against the second urging means.

In these sorts of the initial opening degree setting mechanisms such as disclosed in JP-A-3-271528, since such as the relief lever, the throttle lever being engaged with the relief lever, the first and second urging means and the stopper are disposed at around one end of the throttle shaft, a collective arrangement of these parts is achieved. However, in such conventional structure, the sleeve constituting one element of the relief lever and serving as a supporting member is fitted into the boss portion formed on the side wall of the throttle body, therefore, when the sleeve follows the rotation of the throttle shaft during control of the throttle opening degree, then the sleeve slides around the outer circumference of the boss portion to thereby cause a friction between the sleeve and the boss portion which is required to be reduced as much as possible, because such friction operates as a load with respect to the return spring and the motor drive.

Further, in connection with the collective arrangement of the parts for the throttle initial opening degree setting mechanism, when a so called limp home mechanism is incorporated which, in case when circuits and actuators for throttle control unit in an electrically control throttling system or an electric throttle control system malfunction, permits self pulling by mechanically coupling the acceleration pedal with the throttle valve, a collective and rational arrangement of the parts of the limp home mechanism is also desired.

In this sort of the limp home mechanism, since the throttle shaft is driven and controlled by a motor during a steady state traveling, the acceleration lever for the self-pulling never engages with the throttle lever directly connected to the throttle shaft, when the acceleration pedal is depressed. However, during a traction control such as for preventing slipping the throttle lever is suddenly returned with respect to the acceleration lever and the throttle lever resultantly engages with the acceleration lever to thereby cause a kick-back of applying a return force on the acceleration lever which was one of problems to be solved.

Further, both a throttle shaft torque T1 which is provided by the return spring serving as the first urging means uring the throttle valve in its closing direction and another throttle shaft torque T2 which is provided by the spring used for predetermining the initial opening degree and serving as the second urging means urging the throttle valve in its opening direction are generally designed to satify the following two inequations in order to keep a predetermined margin at the position of the throttle initial opening degree $$T1=Mf\times Ge+Vf$$

$$T2=Mf\times Ge+Vf$$

wherein, Mf; friction torque when the motor is standstill, Ge; reduction gear ratio, Vf; necessary torque to be applied on the throttle shaft so as to open the throttle valve.

In JP(PCT)-A-2-500677 and JP-A-4-203219, it is designed that a relationship of $T1<T2$ stands below a predetermined throttle opening degree near the throttle fully closed position. On the other hand, in JP-A-3-271528, it is designed to permit a relationship of $T1\geqq T2$, because the spring force of the return spring serving as the first urging means is received by the stopper for the initial opening degree and the shaft torque T2 at the position of the throttle initial opening degree can be set without being restricted by the shaft torque T1. Anyway, the first and the second urging means are designed based on the above two inequations.

Since T1 is a shaft torque which urges the throttle valve in its closing direction which is hereinbelow assumed as positive direction and T2 is a shaft torque which urges the throttle valve in its opening direction which is hereinbelow assumed as negative direction, as explained above, a shaft torque steped difference $T1-(-T2)$ between the throttle shaft torques due to the first and second urging means is generated which suddenly changes at the reference position of the throttle initial opening degree. Since the larger the shaft torque stepped difference the harder the control of the throttle valve opening degree, it is preferable to minimize the shaft torque stepped difference in order to increase an accuracy of the throttle valve control.

SUMMARY OF THE INVENTION

The present invention was achieved in view of the above explained several problems. Thus, an object of the present invention is primarily to collectively and rationally arrange parts belonging to a throttle valve initial opening degree setting mechanism and, if required, parts belonging to other mechanisms including such as a limp home mechanism. Through the enhancement of rationalization with respect to mounting of the throttle valve initial opening degree setting mechanism, several advantages are achieved such as reduction of frictions inherent to the. mechanisms, and an improvement in characteristics of the urging means, for example, an improvement in spring characteristics of such as the return spring in comparison with conventional devices, thereby a driving load for a throttle valve actuator is reduced, a throttle valve control operation is stabilized and assembly works of the parts are improved and simplified.

A throttle device for an internal combustion engine according to first aspect of the present invention which includes a motor used as an actuator in a throttle control system, a fully closed position setting mechanism for setting a fully closed position of a throttle valve, and an initial opening degree setting mechanism which keeps an initial opening degree of the throttle valve larger than that of the fully closed position when no current is supplied to the motor, wherein the initial opening degree setting mechanism comprises a fitting member rotatably fitted onto a throttle shaft for the throttle valve, a first urging means urging the fitting member in the direction of closing the throttle valve, an engaging means secured to the throttle shaft and being engageable with the fitting member via a force due to the first urging means, a stopper which prevents the fitting member being rotated beyond the position of the initial opening degree of the throttle valve in its closing direction, and a second urging means which provides to the throttle shaft a throttle valve opening force near the fully closed position so as to keep the initial opening degree of the throttle valve, and wherein in an operating region beyond the initial opening degree of the throttle valve the fitting member is normally rotated integrally with the throttle shaft while being carried on the throttle shaft.

According to the above constitutional structure, under a condition of an engine key switch being turned off, in other words no current being supplied to the motor a throttle valve closing force due to the first urging means is applied to the throttle shaft via the fitting member and the engaging member securred to the throttle shaft, and the fitting member is engageably stopped by the stopper at the position of the throttle initial opening degree, further through the application of the throttle opening force of the second urging means on the throttle shaft the throttle valve is kept at the position of the initial opening degree which is larger than that of fully closed position.

Further, when the opening degree of the throttle valve is controlled by the motor in the region beyond the throttle initial opening degree, the fitting member is normally operated integrally with the throttle shaft under the condition wherein the fitting member is carried on the throttle shaft, therefore, substantially no friction is generated between the throttle shaft and the fitting member. For this reason, a spring loading force of the first urging means can be limited and resultantly a required throttle shaft torque T1 can be reduced, thereby a driving load for the motor is decreased. Further, the shaft torque stepped difference $T1-(-T2)$ between the two throttle shaft torques which is generated across the reference position of the throttle initial opening degree can also be reduced to thereby enhance the stability of the throttle valve drive control.

A throttle device for an internal combustion engine according to a second aspect of the present invention which includes a motor which drives a throttle shaft for performing an open and close control of a throttle valve, a fully closed position setting mechanism for setting a fully closed position of a throttle valve, and an initial opening degree setting mechanism which keeps an initial opening degree of the throttle valve larger than that of the fully closed position when no current is supplied to the motor, wherein the initial opening degree setting mechanism comprises, as the elements thereof, a throttle lever, a return lever, a first urging means, a second urging means, a first sleeve and a second sleeve, and wherein the throttle lever and the first sleeve are inserted into an end of the throttle shaft and are secured there via a clamping force in the axial direction of a nut, the second sleeve being integrated with the return lever is fitted to the first sleeve so as to permit a relative rotational movement and further urged by the first urging means to the position of the initial opening degree in the direction of closing the throttle valve, through the urging force the return lever is caused to be engageable with the throttle lever, and the throttle shaft is applied of a throttle valve opening force by the second urging means so as to keep the initial opening degree of the throttle valve near the fully closed position.

According to the above constitutional structure, under a condition of an engine key switch being turned off, in other words no current being supplied to the motor a throttle valve closing force due to the first urging means is applied to the throttle shaft via the engagement of the return lever and the throttle lever, and the return lever and its second sleeve are engageably stopped by the stopper at the position of the throttle initial opening degree, further through the application of the throttle opening force of the second urging means on the throttle shaft the throttle valve is kept at the position of the initial opening degree which is larger than that of fully closed position.

Further, when the opening degree of the throttle valve is controlled by the motor in the region beyond the throttle initial opening degree, the second sleeve with the return lever is normally operated integrally with the throttle shaft under the condition wherein the second sleeve with the return lever is carried on the throttle shaft, more specifically on the first sleeve, therefore, substantially no friction is generated between the first and second sleeves. For this reason, a spring loading force of the first urging means can be limited and resultantly a required throttle shaft torque T1 can be reduced, thereby a driving load for the motor is decreased. Further, the shaft torque stepped difference T1−(−T2) between the two throttle shaft torques which is generated across the reference position of the throttle initial opening degree can also be reduced to thereby enhance the stability of the throttle valve drive control. Namely, the above functions and advantages are substantially the same as of the first aspect of the present invention.

Still further, according to the second aspect of the present invention, parts belonging to the initial opening degree setting mechanism are installed in such a manner that the first sleeve, the second sleeve with the return lever, the throttle lever and, if required such as spacers are successively inserted into an end of the throttle shaft and are clamped there through a nut, thereby the assembly work of these parts is simplified.

A throttle device for an internal combustion engine according to a third aspect of the present invention comprises the above explained return spring serving as the first urging means and the spring used for determining the initial opening degree and serving as the second urging means, wherein a spring holder divided into two parts along the shaft direction is disposed on the throttle shaft, the spring holder is provided with two spring receiving spaces one being inside and the other being outside by partitioning the same and with a plurality of cut-outs which permit the ends of the respective springs received in respective partitioned spaces to be led out from the spring holder so as to connect with predetermined members and one of the return spring and the spring used for determining the initial opening degree is received in the outside space of the spring holder and the other is received in the inside space of the spring holder.

According to the above constitutional structure, when the return spring and the spring used for determining the initial opening degree are constituted by torsion springs such as coil springs, collective arrangement of parts is achieved as well as an interference between the two springs is prevented.

Further, when the return spring is disposed inside space of spring holder and the spring used for determining the initial opening degree is disposed in the outside space of the spring holder, since the spring constant of a spring disposed inside space of the spring holder can be reduced because of the small coil diameter of the spring, the spring characteristic of the return spring defined by spring loading in ordinate and throttle opening degree in abscissa can be flattened as much as possible. As a result, a load of the actuator for driving the throttle valve can be reduced.

A throttle device for an internal combustion engine according to a fourth aspect of the present invention which includes a motor used as an actuator in a throttle control system, a fully closed position setting mechanism for setting a fully closed position of a throttle valve, and an initial opening degree setting mechanism which keeps an initial opening degree of the throttle valve larger than that of the fully closed position when no current is supplied to the motor, wherein a reduction gear mechanism used for amplifying the driving force of the motor is disposed at one end of a throttle shaft for the throttle valve passing through a throttle body, a screw used for adjusting an opening degree for an idling operation which is used as a stopper in the fully closed position setting mechanism is disposed on a side wall of the throttle body at the side where the reduction gear mechanism is disposed and another screw used for adjusting the initial opening degree which is used as stopper in the initial opening degree setting mechanism is also disposed on a side wall of the throttle body.

According to the above constitutional structure, with the screw used for adjusting the opening degree for an idling operation serving as the stopper in the fully closed position setting mechanism and the screw used for adjusting the initial opening degree serving as the stopper in the initial opening degree setting mechanism the respective opening degrees can be freely set, in addition, since the stopper in the fully closed position setting mechanism is disposed at the side where the reduction gear mechanism is disposed, the distance between the reduction gear position at which a torque is provided for the throttle shaft and the stopper which determines the fully closed position is shortened, a torsional force generated on the throttle shaft between the stopper and the reduction gear is reduced.

Further, when a gear element attached to the throttle shaft in the reduction gear mechanism is formed in a fan shaped gear and the screw used for adjusting the opening degree for an idling operation and serving as the stopper in the fully closed position setting mechanism is disposed so as to abut to one side of the fan shaped gear, a part of the gear can be served as a stopper engaging member at the side of the throttle shaft.

A throttle device for an internal combustion engine according to fifth aspect of the present invention comprises:

- a motor used as an actuator which drives a throttle shaft for a throttle valve;
- a first stopper for setting a fully closed position of the throttle valve;
- a lever A fitted at an end of the throttle shaft so as to permit a rotational movement with respect to the throttle shaft;

(which corresponds to the fitting member according to the first aspect of the present invention and also corresponds to the sleeve with the return lever according to the second aspect of the present invention);

- a return spring which urges the lever A in the direction of closing the throttle valve;
- a lever B which is secured to an end of the throttle shaft and is permitted to be engageable with the lever A by a spring force due to the return spring;

(which corresponds to the engaging member according to the first aspect of the present invention and also corresponds to the throttle lever according to the second aspect of the present invention);

a second stopper which sets a position where an initial opening degree of the throttle valve, when no current is supplied to the motor, is larger than the opening degree of the fully closed position of the throttle valve and prevents the lever A from rotating in the direction of closing from the position of the initial opening degree;

a spring used for determining the initial opening degree which provides a throttle valve opening force to the throttle shaft so as to keep the initial opening degree an acceleration shaft which is disposed in an off-set position with respect to the throttle shaft and is interlockable with an acceleration pedal; and a lever C serving as an acceleration lever used for a limp home function which rotates integrally with the accelerating shaft and is engageable with the lever A when the acceleration pedal rotates beyond a predetermined rotation angle so as to actuate self-pulling function with the acceleration pedal when the motor is inoperable due to malfunctioning of an electric throttle control system.

According to the above constitutional structure, like the first aspect of the present invention, the setting of the throttle initial opening degree and the electrical control of the throttle valve can be achieved, in addition thereto, the following limp home mechanism is actuated when the motor becomes inoperative.

When the motor is inoperative and the acceleration pedal is depressed againt the spring force of the return spring to rotate the acceleration shaft upto a predetermined rotating angle position, the lever C engages with the lever A fitted to the throttle shaft. Thereby, the lever A is rotated in the direction of opening the throttle valve, and the lever B secured to the throttle shaft follows the lever A by the spring force in the direction of opening due to the spring used for determining the throttle initial opening degree and opens the throttle valve.

Thus, an emergency self pulling, in other words a limp home function, is effected. Further, parts of levers used respectively for the throttle initial opening degree setting mechanism and the limp home mechanism and springs therefor can be used commonly, therefore, a collective and rational arrangement and use of the parts thereof are achieved.

Further, when the throttle device is normal and is electrically controlled and further in case when the tranction control is activated, in particular, when the driver fully depresses the acceleration pedal upon occurrence of a slip and in response thereto the throttle control system effects to rotate the throttle valve in its closing direction so as to prevent the slipping, the lever A may engage with the lever C. However, even if such engagement occurs, the throttle shaft can be rotated in its closing direction while leaving the lever A as it is, therefore, the limp home mechanism never operates to disturb the performance of the traction control.

A throttle device for an internal combustion engine according to a sixth aspect of the present invention which includes a motor used as an actuator in a throttle control system, a fully closed position setting mechanism for setting a fully closed position of a throttle valve, and an initial opening degree setting mechanism which keeps an initial opening degree of the throttle valve larger than that of the fully closed position when no current is supplied to the motor, wherein a reduction gear mechanism of the motor which drives a throttle shaft for the throttle valve is disposed at one of the side walls of a throttle body, a casing portion is formed at the opposit side wall of the one side wall of the throttle body, an end of the throttle shaft and an acceleration shaft interlocked with an acceleration pedal are introduced into the casing portion, a throttle position sensor, acceleration pedal position sensor and the initial opening degree setting mechanism are installed within the casing portion and a member supporting the acceleration shaft and acceleration pedal position sensor serves as a cover of the casing portion.

According to the above constituting structure, in addition to the initial opening degree setting mechanism the throttle position sensor and the acceleration pedal position sensor which are used for an electrical control of the throttle valve can be collectively disposed inside the common casing portion provided at the side wall of the throttle body. Moreover, since the cover of the casing portion is used commonly as the supporting member for the acceleration shaft and the acceleration pedal position sensor, a rationalized use of parts thereof is achieved.

A throttle device for an internal combustion engine according to a seventh aspect of the present invention which includes a motor used as an actuator for driving a throttle valve and a reduction gear mechanism, a throttle sensor for detection position relating to the opening degree of the throttle valve, and an initial opening degree setting mechanism which keeps an initial opening degree of the throttle valve larger than that of the fully closed position when no current is supplied to the motor, wherein the reduction gear mechanism and the initial opening degree setting mechanism are disposed at one side with reference to a throttle body and the throttle position sensor is disposed at the other side with reference to the throttle body.

A mechanism having a mechanical sliding portion, for example a sliding portion of intermetallic members, such as the reduction gear mechanism is likely to generate weared powders. According to the above constitutional strucure, the reduction gear mechanism and the throttle position sensor are disposed in a spaced apart relationship via the throttle body, because of the above spaced arrangement structure an inclusion of the weared powders into the throttle position sensor is prevented and a performance degradation of the throttle position sensor is also prevented.

Further, since the reduction gear mechanism as well as the throttle initial opening degree setting mechanism are collectively arranged inside the casing near the motor location, a collective arrangement of parts thereof is achieved as well as the down sizing the entire throttle device is also achieved. Moreover, the throttle position sensor can be designed to be disposed near the center of the throttle body as much as possible, resultantly, influences due to deflection and bending of the throttle shaft is eliminated and a variation of output characteristic of the throttle position sensor can be limited.

A throttle device for an internal combustion engine according to eighth aspect of the present invention comprises a first urging means which urges a throttle valve in its closing direction in a region beyond a throttle valve opening degree defined by a stopper used for setting a throttle initial opening degree and a second urging means which urges the throttle valve in its opening direction so as to keep the throttle initial opening degree near the fully closed position thereof, wherein when assuming that a shaft torque in the direction of closing the throttle valve provided by the first urging means at the position of the stopper used for setting the initial opening degree is T1 and another shaft torque in the direction of opening the throttle valve provided at the position of the stopper used for setting the initial opening degree is T2, the following inequations are satisfied;

$$T1 \geqq Mf \times Ge + Vf$$

$$T2 \leqq Mf \times Ge + Vf$$

wherein, Mf; friction torque when the motor is standstill, Ge; reduction gear ratio, Vf; necessary torque to be applied on the throttle shaft so as to open the throttle valve.

According to the above constitutional structure, through minimizing the throttle shaft torque characteristics T1 and T2 the stepped difference of the throttle shaft torques T1−(−T2) near the position of the throttle initial opening degree can be reduced, thereby a stabilization of the throttle drive control is achieved. Further, in case when $T2 < Mf \times Ge + Vf$, T2 is slightly sacrificed at the position of the initial opening degree as illustrated in FIG. 16 which will be explained later and a resident error is generated at the position of the throttle initial opening degree. However, in spite of this resident error, if an air flow rate necessary for a combustion required from the vehicle side during a cold climate start is ensured, an intended purpose for the initial opening degree will be satisfied.

DETAILED DESCRIPTION OF THE PREFERRED EMBODIMENTS

Now, several embodiments of the present invention are explained with reference to the drawings.

Figure 1:
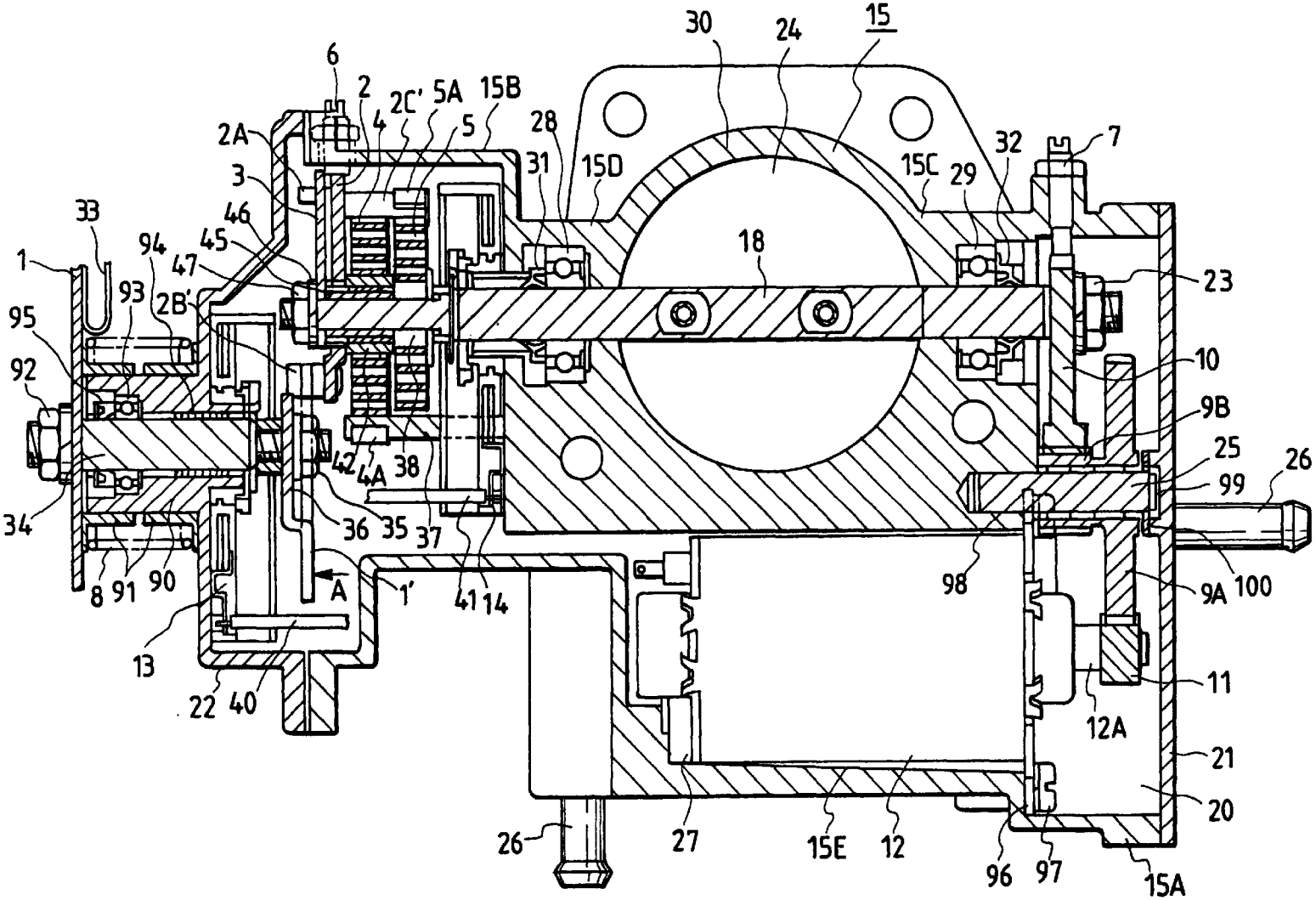
FIG. 1 is a cross sectional view of a first embodiment according to the present invention
Figure 2:
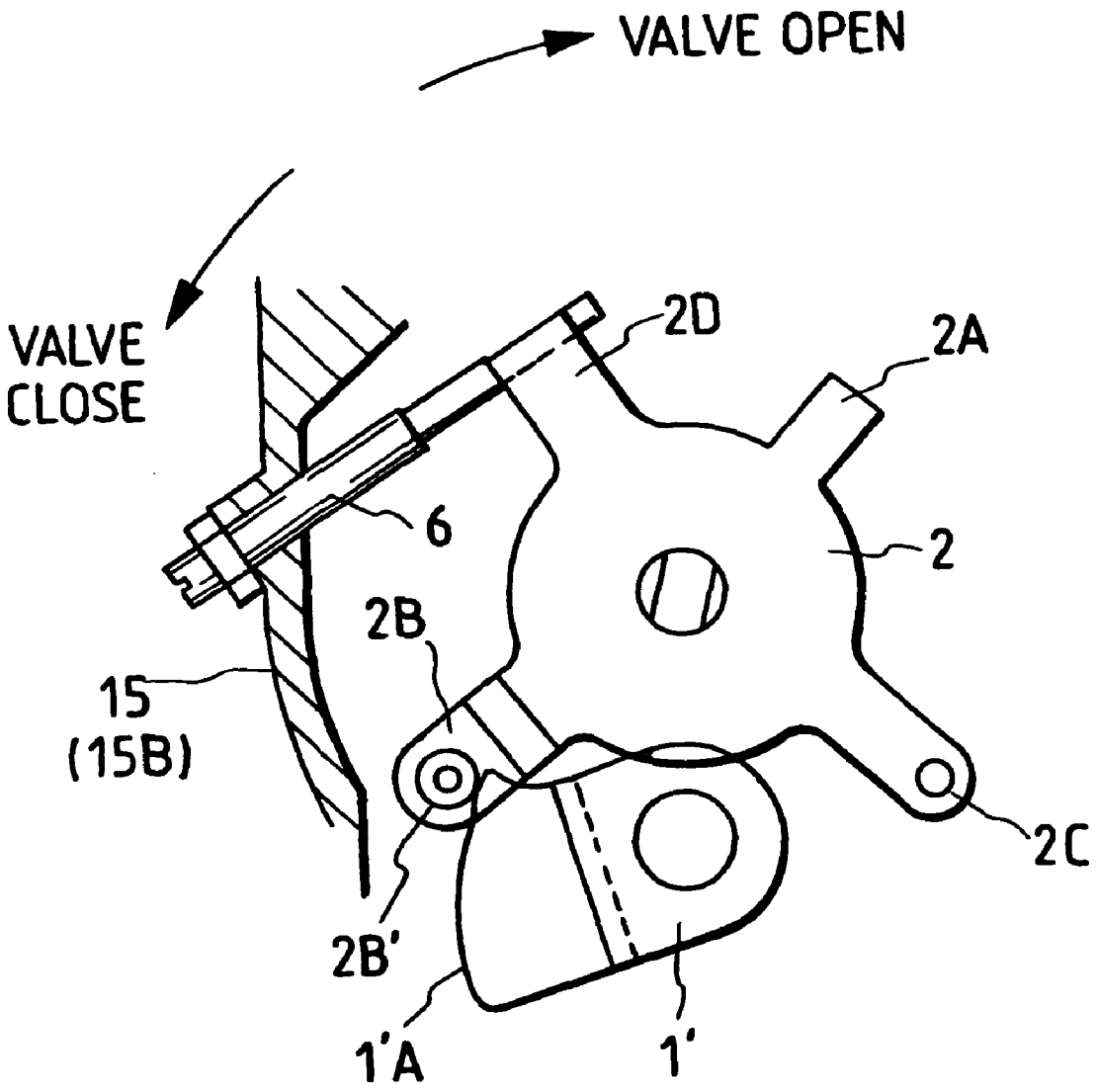
FIG. 2 is a view seen from an arrow A in FIG. 1
Figures 3, 3A:
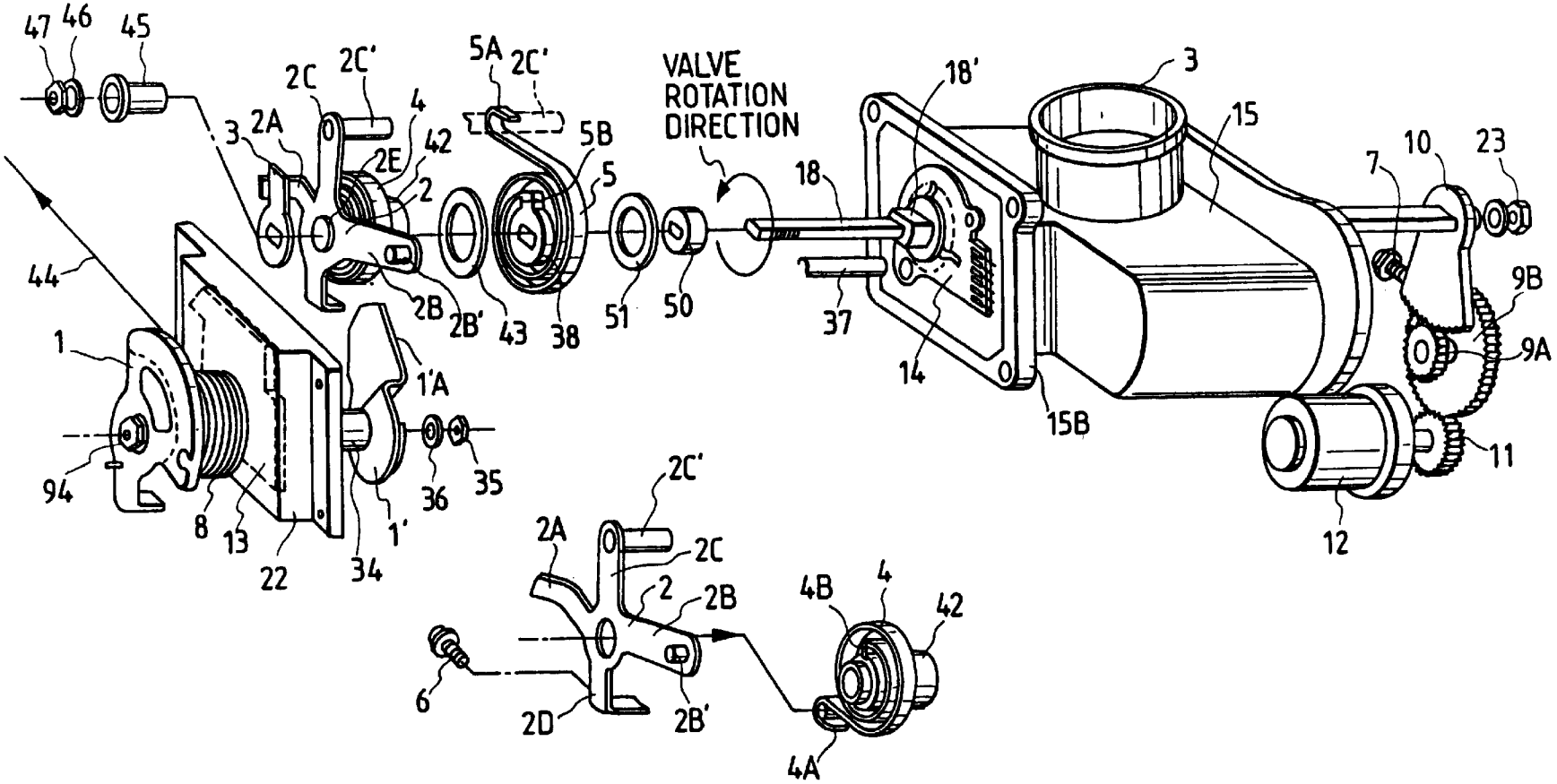
FIG. 3 is an exploded perspective view of the first embodiment according to the present invention.
Figure 4B:
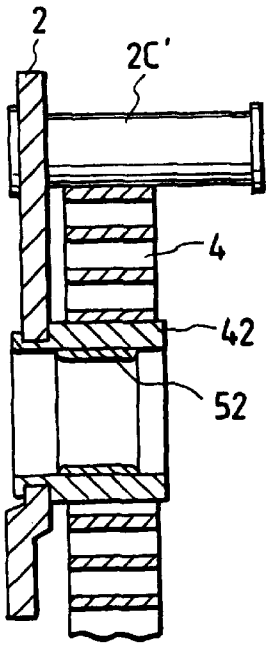
FIGS. 4A and 4B are cross sectional views of major portions of the first embodiment according to the present invention.
Figure 4A:
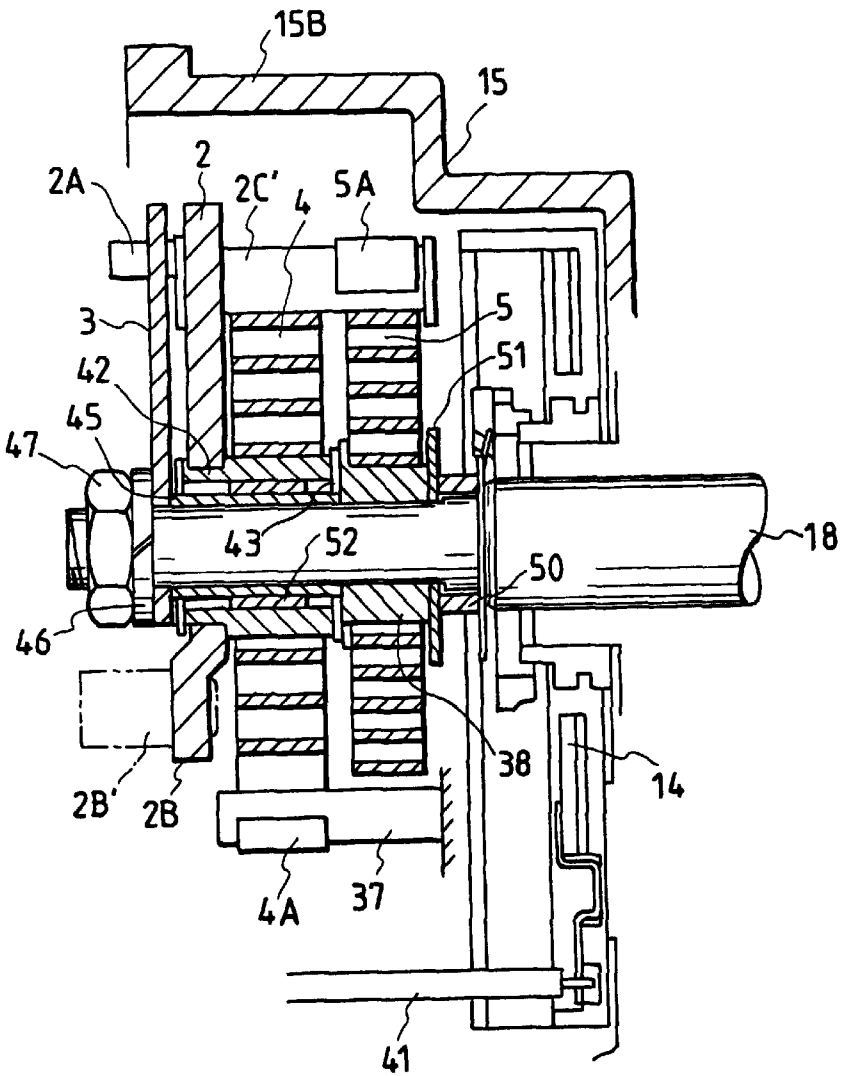

FIG. 1 is a vertical cross sectional view showing a throttle device representing a first embodiment according to the present invention, FIG. 2 is a view seen from an arrow A in FIG. 1, FIG. 3 is a exploded perspective view thereof and FIGS. 4A and 4B are cross sectional views of major portions thereof.

In these drawings a throttle body 15 is, for example, made of an aluminium die cast and inside of which an intake air passage or bore 30 is formed. In the throttle body 15, a throttle shaft 18 passes through across the intake air passage 30 and is supported via bearings 28 and 29 so as to permit free rotational movement, and a throttle valve 24 which controls an intake air flow rate through the intake air passage 30 is secured to the throttle shaft 18. Numeral 26 is a pipe which passes engine cooling water to the throttle body 15, thereby the throttle body 15 is kept at the temperature of the engine cooling water.

Among side walls of the throttle body 15, at one of right and left side walls through which throttle shaft 18 crosses, a bearing receiving portion 15C receiving the bearing 29 and a seal 32 and a casing portion 15A receiving a driving use gear group for an electric throttle control system are integrally formed with the throttle body 15, and at the opposite side thereof another bearing receiving portion 15D receiving the bearing 28 and a seal 31 and a casing portion 15B receiving a limp home mechanism and an initial opening degree setting mechanism for the throttle valve 24 are disposed.

The limp home mechanism is designed to permit an emergency self pulling of the vehicle with a mechanical acceleration mechanism in case when an electronic throttling including such as an actuator and a control system therefor malfunctions. The initial opening degree setting mechanism is designed to set an initial opening degree of the throttle valve 24 when an engine key switch is turned off, in other words no current is supplied to a motor 12. The initial opening degree of the throttle valve 24 is set, for example, at 5°(±0.2°) and also set larger than an opening degree of throttle valve fully closed position which corresponds to an opening degree ensuring an air flow rate for an idling operation. The constitutional structures of the limp home mechanism and the initial opening degree setting mechanism will be explained later. However, the necessity of setting the initial opening degree is already explained, therefore, the explanation thereof is omitted.

The gear group receiving casing portion 15A is covered by a cover 21 which is detachably secured by screws, and gears such as 11, 9A, 9B and 10 for a throttle driving system are received in an inner space 20 of the casing portion 15A. On the other hand, the casing portion 15B receives such as acceleration levers 1 and 1', an acceleration shaft 34 and an acceleration pedal position sensor 13 and is covered by a cover 22 which is detachably secured by screws.

The acceleration lever cover 22 has a boss portion 90 which supports the acceleration shaft 34 passing through the acceleration cover 22 via bearings 93 and 94 and at an end of the acceleration shaft 34 the first acceleration lever 1 with an acceleration wire connecting portion 33 is fixedly arranged.

Arround the outer circumference of the boss portion 90 a spring supporting member 91 is fitted. The other end of the acceleration shaft 34 is introduced into the cover 22 and is fixedly arranged to the second acceleration lever 1' serving as a cam lever. The fixedly arrangement of these levers 1 and 1' is carried out by making use of forced sandwitching between clamping nuts 35 and 92 disposed at both ends of the acceleration shaft 34 and stepped portions formed on the acceleration shaft 34.

Around the outer circumference of the spring supporting member 91 an acceleration use return spring 8 constituted by a coil shaped torsion spring is installed. One end of the return spring 8 is connected to the side of the first acceleration lever 1 and the other end thereof is connected to the side of the cover 22, thereby the return spring 8 urges the acceleration shaft 34, and the acceleration levers 1 and 1' in the direction of closing. When an acceleration pedal is depressed, the acceleration levers 1 and 1' are rotated via a wire 44 in the direction of opening against the spring force of the return spring 8.

However, when the throttle shaft 18 is electrically rotated by the motor 12, the cam shaped acceleration lever 1 and 1' never transmits a driving force to the throttle shaft 18. Numeral 95 is a sealing member.

At one part of the side walls of the throttle body 15, in the drawings at the bottom part thereof, a motor casing portion 15E is provided in a manner in parallel with the throttle shaft 18 and in the motor casing portion 15E the motor 12 serving as an actuator for the electronic throttling is received. Such as a DC motor and a stepping motor are used for the motor 12.

The inner circumference of the motor casing portion 15E is configurated in a taper shape so as to facilitate insertion of the motor 12 thereinto, and at the deepest end of the motor casing portion 15E an elastic member 27 is placed and at the opening portion of the motor casing portion 15E a motor securing plate 96 is disposed, thereby, when a screw 97 is clamped, the motor 12 is forcedly sandwiched between the elastic member 27 and the securing plate 96.

A motor gear 11 serving as a pinion gear provided at a shaft 12A of the motor 12 engages with an intermediate gear 9A. The intermediate gear 9A is designed to have a larger gear ratio than that of the motor gear 11 to reduce speed and to increase torque, and this increased rotational torque is further transmitted to the throttle shaft 18 via another intermediate gear 9B and a throttle gear 10.

The intermediate gears 9A and 9B are an integrated type and are loosely fitted to a gear supporting use shaft 25 which is arranged in parallel with the throttle shaft 18 so as to permit rotational movement, and one end of the gear supporting use shaft 25 is press fitted and supported by a bore 98 formed in a side wall of the throttle body 15 and other end thereof is pressed by the cover 21 via a nylon washer 100 to prevent the intermediate gears 9A and 9B from dropping out the gear supporting use shaft 25.

The throttle gear 10 is secured to one end of the throttle shaft 18 by clamping a nut 23 thereto. A fan shaped gear as illustrated in FIG. 3 is, for example, used for the throttle gear 10, and when the throttle gear 10 is rotated in the direction of closing the throttle valve 24, the one side of the throttle gear 10 finally hits a screw 7 for adjusting a throttle valve fully closed position, in other words a screw for adjusting an opening degree for an idling operation or a first stopper which is provided at a side wall of the throttle body 15, thereby further rotation of the throttle shaft 18 in the closing direction is restricted, thus the fully closed position of the throttle valve 24 is determined. The throttle valve fully closed position is set at a minimum opening degree which ensures an air flow rate for an idling operation after warming-up operation.

Since the throttle device according to the present embodiment employs an electric throttling system, as far as the driving use motor 12 in the throttle control system is operating normally, a driving force of the motor 12 provides a rotational torque to the throttle shaft 18 via the reduction gear mechanism.

Figure 5:
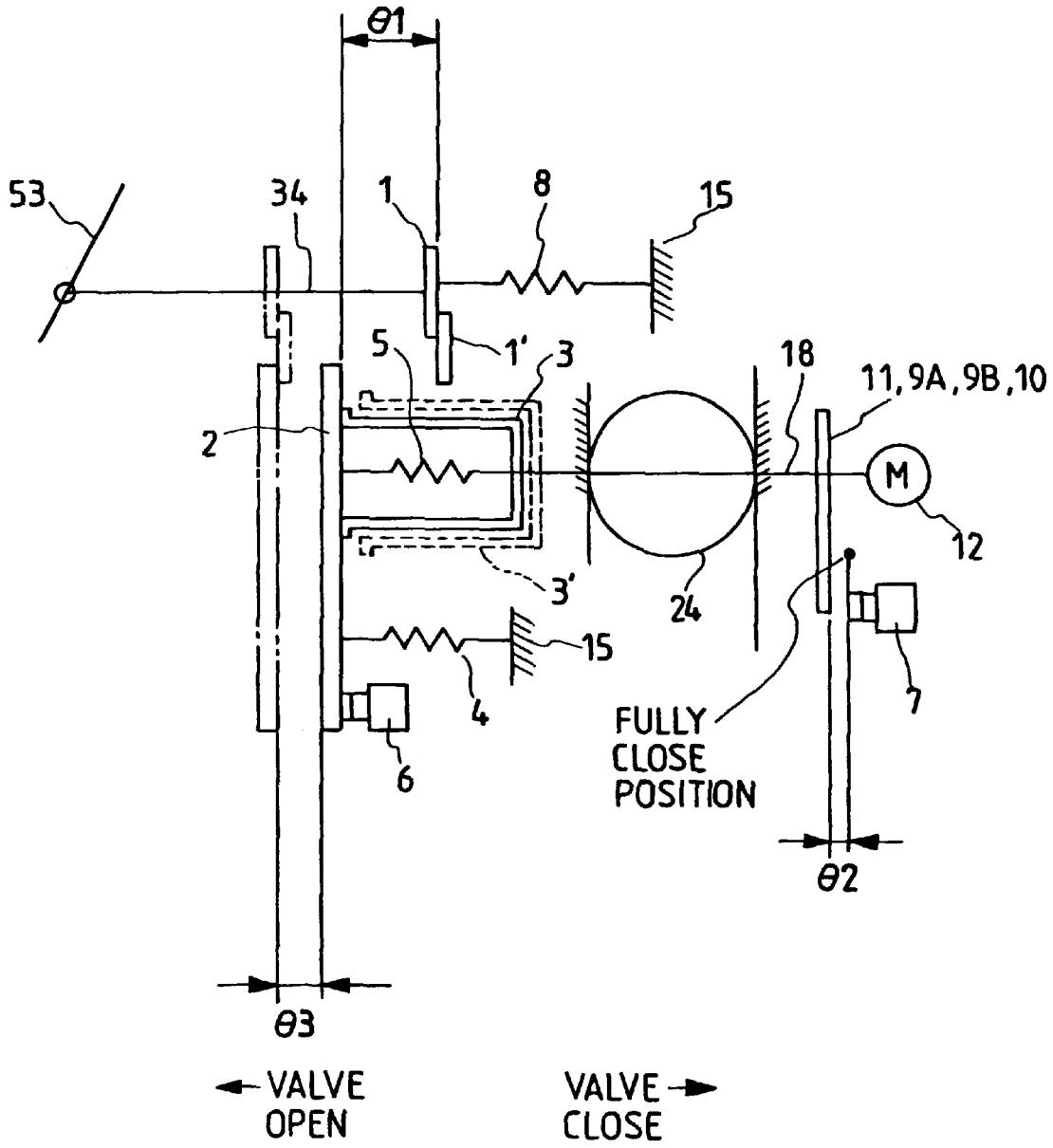
FIG. 5 is a view for explaining an operating principle of the present invention.

A driving current is supplied to the motor 12 from a throttle control module (TCM) not shown. The TCM prepares a drive current command signal in the following manner. Namely, using such as an acceleration position signal from an acceleration position sensor 13 which detects a depressing amount of an acceleration pedal 53 as shown in FIG. 5 and hereinbelow sometimes called as an acceleration sensor, a throttle opening degree signal from a throttle position sensor 14 which is hereinbelow sometimes called as a throttle sensor, an engine rpm and a slip signal, the command signal is prepared in response to the current operating requirement such as a normal engine operating control and a traction control.

In order that a mechanical driving force from the acceleration pedal 53 is not transmitted to the throttle shaft 18 as far as the throttle control system is normally operating, the throttle shaft 18 and the acceleration shaft 34 are physically separated and are arranged in offset and between the throttle shaft 18 and the acceleration shaft 34 the acceleration lever 1' and the lever 2 constituting the elements of the limp home mechanism are disposed.

Now, the limp home mechanism and the initial opening degree setting mechanism are explained hereinbelow. These two mechanisms in the present embodiment are disposed at the opposite side where the reduction gear mechanism in the throttle driving system is provided with reference to the throttle body 15.

The initial opening degree setting mechanism is constituted by a sleeve 42 with the lever 2, in other words a lever A, or a return lever which is fitted to an end of the throttle shaft 18 so as to permit rotary movement with respect to the throttle shaft 18 and which is hereinbelow called as a lever (A) 2, a return spring 4, in other words a first urging means which urges the sleeve 42 with the lever (A) 2 in the direction of closing the throttle valve 24, a lever 3, in other words a lever B or a throttle lever which is engageable with the lever (A) 2 by a spring force due to the return spring 4 secured to one end of the throttle shaft 18 and is hereinbelow called as a lever (B) 3, a screw 6 for adjusting the initial opening degree, in other words a second stopper 6 which prevents rotation in the closing direction of the sleeve 42 with the lever (A) 2 at the position of the initial opening degree when no current is supplied to the motor 12, in other words an engine key switch is turned off, and a spring 5 used for determining the initial opening degree, in other words a second urging means which provides to the throttle shaft 18 a throttle valve opening force for keeping the initial opening degree.

A specific installation structure of these elements is explained with reference to FIGS. 3, 4A and 4B.

As illustrated in FIG. 3, at least one end of the throttle shaft 18 is configurated in a flat shape having two parallel faces, from this one flattened end of the throttle shaft 18 a spacer 50 is inserted upto a shaft stepped portion 18', subsequently a washer 51 is inserted thereinto, thereafter, a chip 38 with the spring 5 used for determining the initial opening degree is inserted thereinto under engagement condition, then after a nylon washer 43 the sleeve 42 with the lever (A) 2 is fitted with a play into the throttle shaft 18 via a sleeve 45, further, the lever (B) 3 is inserted into the throttle shaft 18 under engagement condition and finally a nut 47 is clamped to the throttle shaft via a washer 46.

As illustrated in FIG. 4 (A), one end of the first sleeve 45 abuts to the chip 38 due to the clamping by the nut 47 and the other end thereof abuts to the lever (B) 3, thereby the first sleeve 45 is secured around the circumference of the throttle shaft 18. The clamping force by the nut 47 is only provided for the lever (B) 3, the first sleeve 45 and the chip 38, and not for the second sleeve 42 with the lever (A) 2 which is fitted around the circumference of the first sleeve 45 to thereby permit relative rotational movement of the second sleeve 42 with respect to the throttle shaft 18 and the first sleeve 45.

As illustrated in FIG. 4B, over the inner face of the second sleeve 42 solid lubricating member 52, in other words a dry bearing such as fluororesin coating is applied.

The lever (A) 2 includes arm portions 2A, 2B, 2C and 2D, and is inserted through a center attachment bore 2E into the outer circumference of the second sleeve 42 serving as a fitting member and is integrated with the metal sleeve 42 by cauking.

The arm portions 2A of the lever (A) 2 is set to be engageable with the lever (B) 3, a projection or a roll pin 2B' forming a part of the arm portion 2B is set to be engageable with the acceleration lever or cam lever 1', a projection 2C' forming a part of the arm portion 2C is fixed to one end 5A of the spring 5 used for determining the initial opening degree and the arm portion 2D is set to be engageable to the screw or stopper 6 for adjusting the initial opening degree provided at a side wall of the throttle body 15. The other end 5B of the spring 5 used for determining the initial opening degree is connected to the chip 38.

In the present embodiment, both the return spring 4 and the spring 5 used for determining the initial opening degree respectively use a spiral spring.

One end 4B of the return spring 4 is fixed to the second sleeve 42 and the other end 4A is fixed to the pin 37 provided at a side wall of the throttle body, and through action of the spring force of the return spring 4 the arm portion 2A of the lever (A) 2 engages with the lever (B) 3. With this engagement the return spring 4 urges the throttle shaft 18 and resultantly the throttle valve 24 in its closing direction.

An exemplary operation of the present embodiment is explained with reference to FIG. 5, a diagram illustrating a principle of the present invention and FIGS. 6A, 6B and 7.

When the engine key switch is turned off, in that no current is supplied to the motor 12, through action of the spring force due to the return spring 4 the lever (A) 2 urges via the lever (B) 3 the throttle shaft 18 in the closing direction and the throttle valve 24 is returned to the position corresponding to the initial opening degree. At the position of the initial opening degree, the arm portion 2D of the lever (A) 2 abuts to the stopper 6, thereby, further rotation of the lever (A) 2 in the closing direction is prevented.

With the provision of the stopper 6, the spring force due to the return spring 4 is ineffected from the initial opening degree θ2 of the throttle valve 24 to the fully closed position thereof, and near the fully closed position of the throttle valve 24, in that between the fully closed position and the initial opening degree θ2 of the throttle valve 24, the already explained spring 5 used for determining the initial opening degree is effected, in that a throttle valve opening force is applied onto the throttle shaft 18, thereby the initial opening degree of the throttle valve 24 is kept.

An urging force P1 in the closing direction due to the return spring 4 and an urging face P2 in the opening direction due to the spring 5 used for determining the initial opening degree are respectively determined to keep a relationship of $P1 \geqq P2$, in other words a shaft torque T1 in the closing direction due to the urging force P1 and a shaft torque T2 in the opening direction due to urging force P2 are determined to keep a relationship of $T1>T2$.

When such initial opening degree is kept, even if the throttle valve 24 is ice-bonded during a prior warming up operation in a cold climate, a necessary air flow rate for the engine starting can be ensured.

When controlling the throttle valve 24 to the fully closed position, in that when performing an idling operation after warming up operation, the throttle shaft 18 is rotated in the closing direction against the spring force due to the spring 5 used for determining the initial opening degree with the driving force by the motor 12 based on an idling control command value. In this instance, in a range between the initial opening degree and the fully closed position the lever (B) 3 disengages from the lever (A) 2 as illustrated by a broken line 3' in FIG. 5 and performs a valve closing operation integrally with the throttle shaft 18.

When controlling an opening degree or open and close of the throttle valve 24 in a range exceeding the initial opening degree θ2 under a normal operating condition, the driving force of the motor 12 is transmitted to the throttle shaft 18 via the reduction gear mechanism 9A, 9B, 10 and 11, and the opning degree of the throttle valve 24 is controlled depending on balancing between the driving force and the spring force due to the return spring 4. At this instance, the lever (A) 2 engages with the lever (B) 3 and the second sleeve 42 with the lever (A) 2 is carried on the throttle shaft 18 via the first sleeve 45 and is rotated integrally with the throttle shaft 18.

When the vehicle is under a traction control, for example when the driver fully depresses the acceleration pedal 53 in response to a slip occurrence to cause a large rotational displacement of the acceleration lever 1' and on the other hand, through a command from the TCM the motor 12 controls the throttle valve 24 in its closing direct so as to prevent a slipping, the lever (A) 2 engages in its return course with the acceleration lever 1' and is prevented further rotation in the closing direction. Even when this condition is caused, the lever (B) 3 disengages from the lever (A) 2 and is rotated in the closing direction against the spring force due to the spring 5 used for determining the initial opening degree integrally with the throttle shaft 18, thereby, the control in the direction closing the throttle valve 24, in other words a traction control can be performed without troubles.

When the above condition occurs that the lever (A) 2 engages with the acceleration lever 1' when performing a traction control, a phenomenon in that a kick back phenomenon is caused that the spring force due to the return spring 4 is applied on the acceleration lever 1' via the lever (A) 2 as an impact.

Figures 6A, 6B:
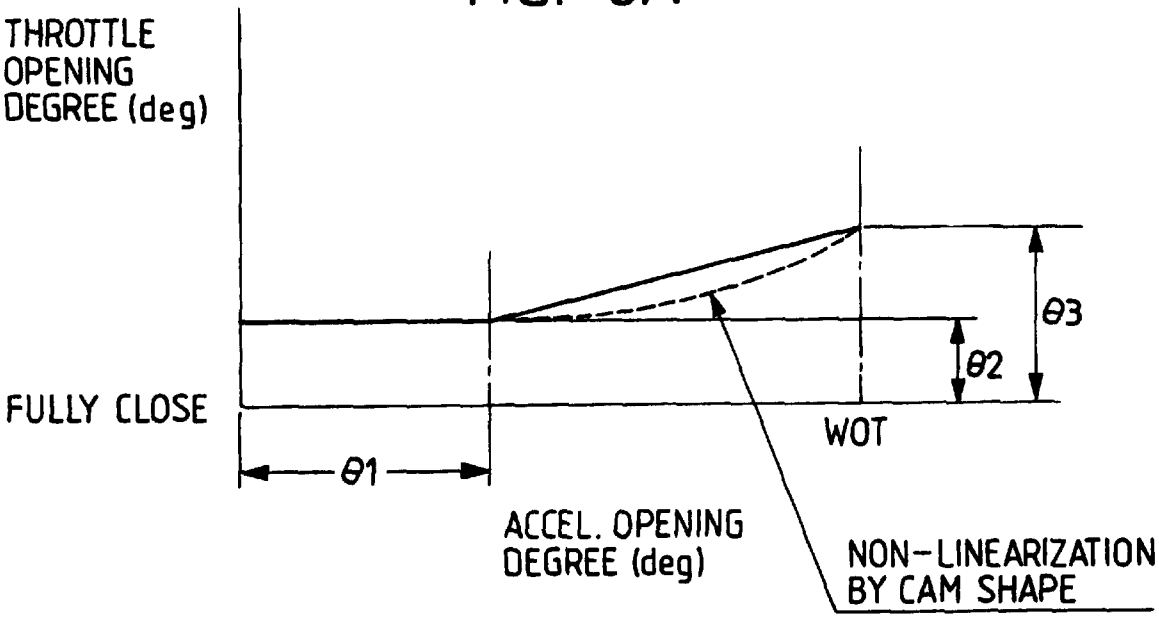
FIGS. 6A and 6B are views for explaining a limp home characteristics included in the first embodiment according to the present invention.
Figure 7:
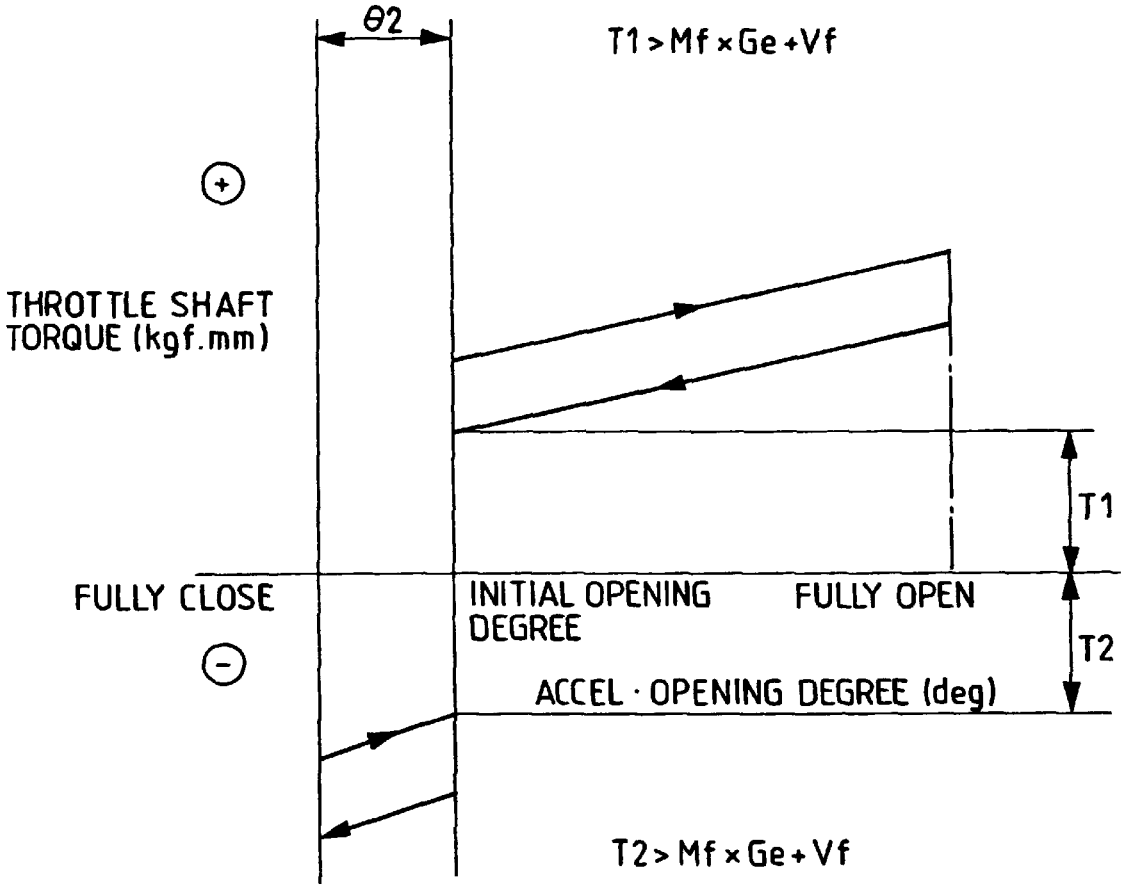
FIG. 7 is a view for explaining a throttle shaft torque characteristic based on the operating principle according to the present invention.

This kick back phenomenon occurs, when the acceleration pedal 53 is depressed and the acceleration shaft 34 rotates more than θ1 as illustrated in FIG. 6A, wherein θ1 is an angle when through rotation of the acceleration shaft 34 by depression of the acceleration pedal 53 the acceleration lever 1' is placed in an engageable condition with the lever (A) 2 at the side of the throttle shaft 18 during a limp home operation, however, when an inclination of a cam characteristic defined by the throttle valve opening degree as ordinate and acceleration pedal opening degree, in that rotating angle of accelerations shaft as abscissa is reduced as much as possible, the acceleration lever 1' receives the spring force of the retun spring 4 at a position where the spring loading thereof is small in case when a traction control is effected where the kick back phenomenon is in particular likely to occur, therefore, the amount of the kick back is reduced.

However, since it is necessary to ensure a throttle opening degree θ3 which is required to carry out a self pulling during a limp home operation, a middle portion of the cam characteristic defined by throttle opening degree and acceleration opening degree is provided a non-linear characterisation as illustrated by a broken line in FIG. 6A moving below a stright line inclination by making use of a cam shape of the acceleration lever 1'.

In the present embodiment, the respective angles θ1, θ2 and θ3 are set as follows as shown in FIG. 6B, in that θ1=30°, the initial opening degree θ2=5° and a throttle opening degree necessary for a limp home operation θ3=7°.

The second sleeve 42 performs a relative rotation on the first sleeve 45 in a range between the initial opening degree θ2 and the fully closed position of the throttle valve 24, further as explained above even during the traction control the second sleeve 42 may perform a relative rotation on the first sleeve 45. The friction caused by the sliding movement is reduced by the solid lubricating member 52.

The limp home mechanism operates in the following manner.

When such as the throttle control system and the motor 12 fail, the throttle valve 24 is returned to the position of the initial opening degree by the spring force due to the return spring 4. Under this condition, when the acceleration pedal 53 is depressed, through a relative rotation of the acceleration shaft 34 with respect to the throttle shaft 18 a cam lever 1'A of the acceleration lever 1 engages with the lever (A) 2, and the lever (A) 2 is rotated in the direction of opening the throttle valve 24 as illustrated by a dot and chain line in FIG. 5. The throttle shaft 18 and the lever (B) 3 follow the rotation in the opening direction of the lever (A) 2 by the spring force due to the spring 5 used for determining the initial opening degree and opens the throttle valve 24 to permit a self pulling by the acceleration pedal 53, in that a limp home operation.

In this instance, in order to ensure the limp home operation, it is necessary to satisfy the following inequations with regard to the shaft torque T1 determined by the urging force P1 due to the return spring 4 at least in a range between the initial opening degree θ2 and the throttle valve fully closed position, and the shaft torque T2 determined by the urging force P2 due to the spring 5 used for determining the initial opening degree at least in a range between the throttle valve fully closed position and the limp home operating region;

$$T1>Mf\times Ge+Vf$$

$$T2>Mf\times Ge+Vf$$

wherein, Mf; friction torque when the motor is standstill, Ge; reduction gear ratio, Vf; necessry torque to be applied on the throttle shaft so as to open the throttle valve.

According to the present embodiment the following advantages are obtained.

a) The second sleeve 42 with the lever (A) 2 used for driving the throttle shaft 18 is carried on the throttle shaft 18 and is rotated integrally with the first sleeve 45 in a substantial opening degree range between the initial opening degree and the throttle valve fully closed position except that under a condition when the acceleration pedal 53 is fully depressed during a traction control the motor 12 effects to close the throttle valve 24, therefore, a possible friction between the second sleeve 42 and the first sleeve 45 is almost eliminated.

Accordingly, the spring force P1 due to the return spring 4 is reduced, resultantly the required shaft torque T1 for the throttle shaft 18 is reduced as well as the driving load for the motor 12 is also reduced. Further, the shaft stepping torque T1−(−T2) between the throttle shaft torques which is caused across the reference position of the throttle initial opening degree is reduced, thereby a stability of the throttle drive control is enhanced.

b) Constitutional elements of the initial opening degree setting mechanism such as the spacer 50, the washer 51, the chip 38 with the spring 5 used for determining the initial opening degree, the first sleeve 45, the return spring 4, the second sleeve 42 with the lever (A) 2 and the lever (B) 3 can be assembled by simply inserting successively into the throttle shaft 18 and clamping by a nut, thereby an installation work thereof is rationalized.

c) The initial opening degree setting mechanism, the limp home mechanism, the throttle sensor 14 and the cover 22 for the casing portion 15B are collectively arranged, moreover, a part of the mechanism parts is used in common, the number and structure of the parts are rationalized and a down sizing of the throttle device is realized. Further, spiral springs are used respectively for the return spring 4 and the spring 5 used for determining the initial opening degree a further compact throttle device is realized.

Further, when such spiral springs are used, ones having a small spring constant can be easily designed, resultantly a reduction of driving load for the motor 12 is enhanced.

d) Both the stopper 7 for the fully closed position setting mechanism or the screw used for adjusting an opening degree for an idling operation and the stopper 6 for the initial opening degree setting mechanism or the screw used for adjusting the initial opening degree can freely set the required opening degrees, further both stoppers are provided respectively on the opposing side walls of the throttle body, the both stoppers can be easily identified without puzzling in view of such as the directions of the side walls and the existence of the reduction gear mechanism and the initial opening degree setting mechanism, thereby an erroneous identification of both stoppers is eliminated and resultantly an erroneous adjustment is prevented.

Further, the stopper 7 for the fully closed position setting mechanism or the screw used for adjusting an opening degree of an idling operation is disposed to abut to one side of the fan shaped gear 10 in the reduction gear mechanism, a part of the gear can be served as a stopper engaging member at the side of the throttle shaft 18.

e) Even when the limp home mechanism and the initial opening degree setting mechanism are mixedly arranged, the operation of the throttle shaft 18 during a traction control is smoothly performed without being disturbed by the limp home mechanism.

Further, with the provision of the non-linear characteristic as illustrated by the broken line in FIG. 6A for the moving characteristic of the acceleration lever 1' in the limp home mechanism, a possible occurrence of kick back during a traction control is effectively suppressed.

Figure 8:
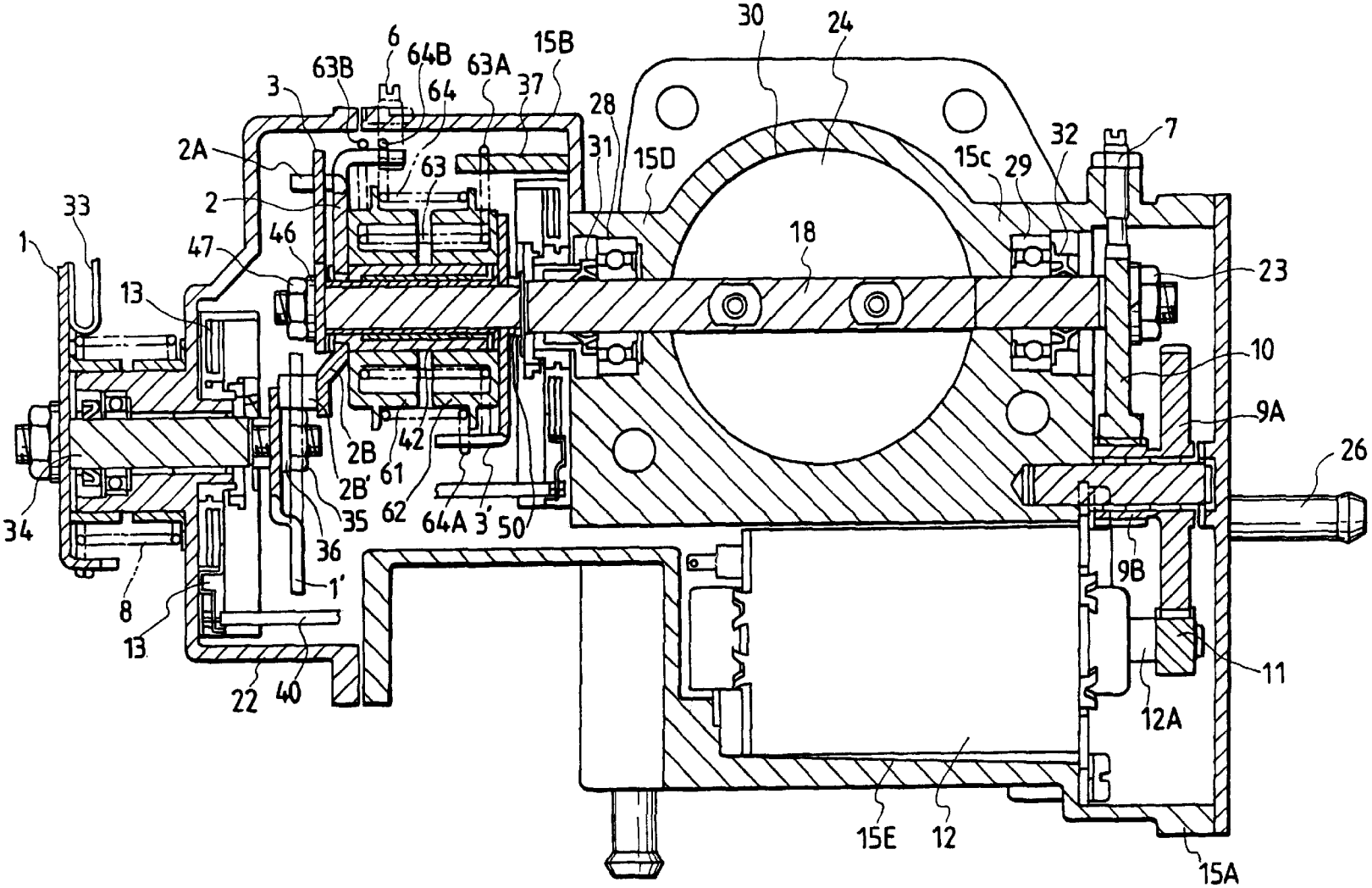
FIG. 8 is a cross sectional view showing a second embodiment according to the present invention.
Figure 9:
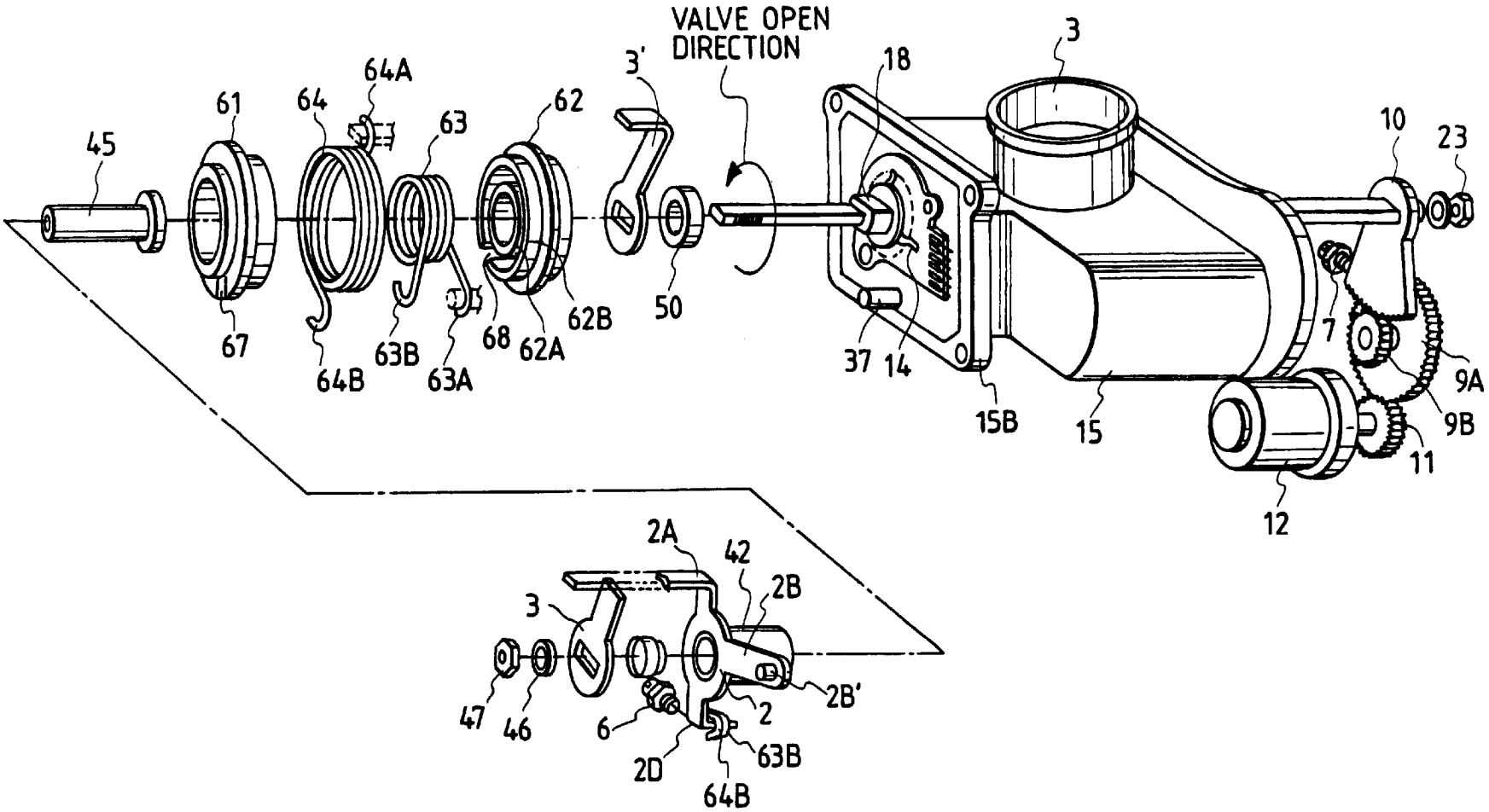
FIG. 9 is an exploded perspective view of a major portion of the second embodiment according to the present invention.
Figure 10B:
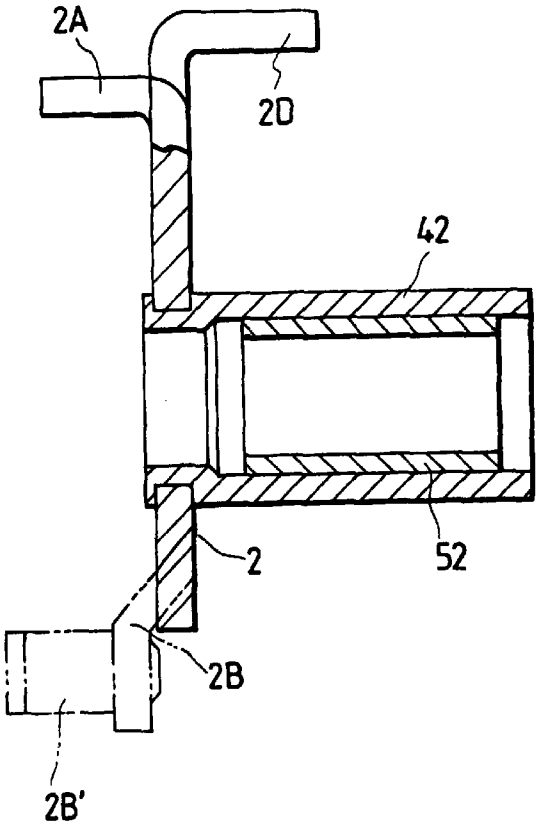
FIGS. 10A and 10B are cross sectional views of major portions of the second embodiment according to the present invention.
Figure 10A:
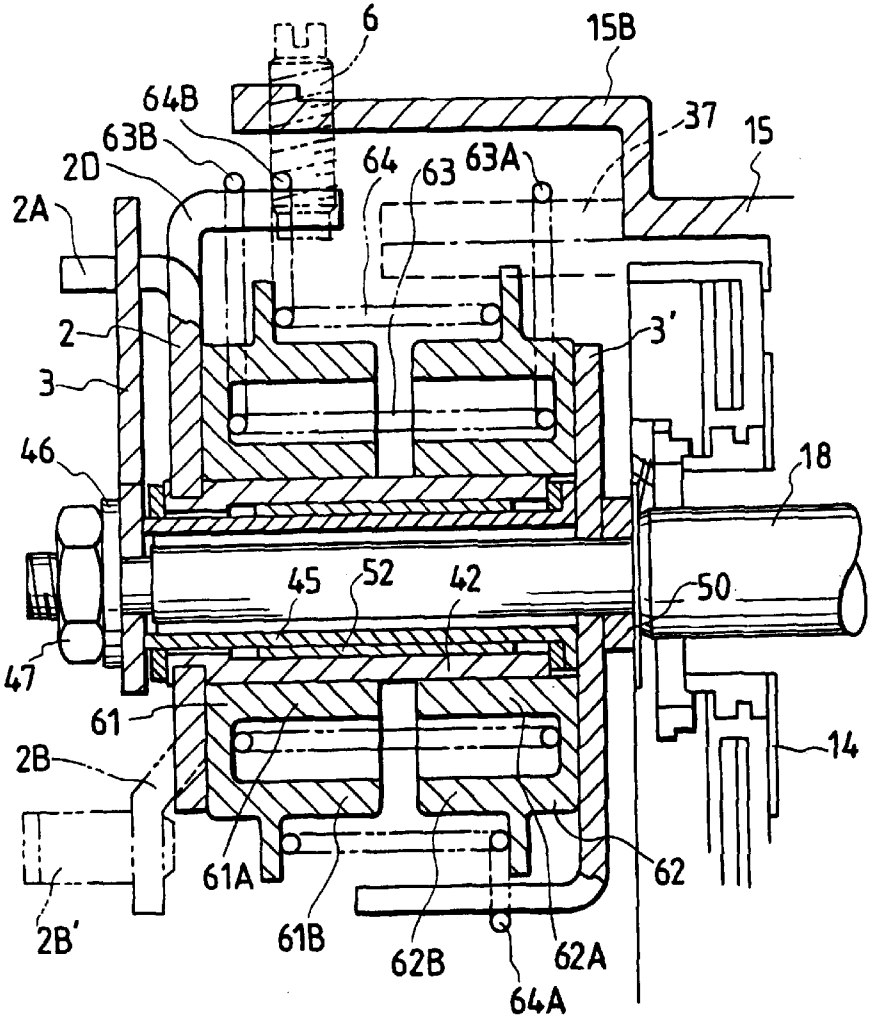

Now, a second embodiment according to the present invention is explained with reference to FIGS. 8 through 10, wherein FIG. 8 is a vertical cross sectional view of the second embodiment, FIG. 9 is an exploded perspective view of a major portion thereof and FIGS. 10A and 10B are cross sectional views of major portions thereof.

The structural principle of the present embodiment is substantially the same as that of the first embodiment except that a part of the parts used therein is modified, therefore, only the modification is explained hereinbelow. Further, elements in the drawings bearing identical numerical references as in the first embodiment show the same or equivalent elements as those of the first embodiment which also applied to all the elements in other embodiments explained later.

In the present embodiment, a coil shaped torsion spring 63 and a coil shaped torsion spring 64 are respectively used for the return spring and the spring used for determining the initial opening degree.

Other than the lever (B) 3, lever (B') 3' is fixedly arranged at one end of the throttle shaft 18, between these fixed levers 3 and 3' the sleeve 45 is arranged which is secured on the throttle shaft 18 by clamping the nut 47 and arround the outer circumference of the sleeve 45 the sleeve 42 with the lever (A) 2 is fitted so as to permit rotation with respect to the sleeve 45.

Around the outer circumference of the sleeve 42 over the throttle shaft 18, spring holders 61 and 62 each having a flange are arranged with a space in the axial direction so as to permit free movement in the rotational direction.

The spring holders 61 and 62 respectively include inner cylindrical portions 61A and 62A which fit around the outer circumference of the sleeve 42 and outer cylindrical portions 61B and 62B which pertitions spring setting space into two spaces, in that inside space and outside space as illustrateted in FIG. 10A, and in the present embodiment, the return spring 63 is arranged in the inside setting space and the spring 64 used for determining the initial opening degree is arranged in the outside setting space.

Further, in the spring holders 61 and 62, cut-outs or spring end leading out portions 67 and 68 as illustrated in FIG. 9 are formed which are used to lead out end portions 63A and 64B of the return spring 63 arranged in the inside setting space to the outside. The end portion 63A of the return spring 63 is fixed through the cut-out 68 to the pin 37 provided at the side wall of the throttle body 15 and the other end portion 63B is fixed through the cut-out 67 to the arm portion 2D of the lever (A) 2.

One end 64A of the spring 64 used for determining the initial opening degree which is disposed in the outer space of the spring holders 61 and 62 is fixed to the lever (B') 3' secured to the throttle shaft 18, and the other end 64B thereof is fixed to the arm portion 2D of the lever (A) 2.

In the present embodiment, the arm portion 2A of the lever (A) 2 is engaged with the lever (B) 3 secured to the throttle shaft 18 by the return spring 63 and the throttle shaft 18 is urged in the direction of closing the throttle valve 24. The lever (A) 2 is prevented to rotate further in the closing direction when abutting to the screw 6 for adjusting the initial opening degree like the first embodiment.

The spring 64 used for determining the initial opening degree urges the throttle shaft 18 in the opening direction thereof via the lever (B') 3' so as to keep the initial opening degree near the fully closed position thereof.

Further, the divided spring holders 61 and 62 receive the spring force of the springs 63 and 64 in their axial direction and are pressed to the levers 3 and 3'.

According to the present embodiment, the following advantages in addition to those obtained in the first embodiment are further obtained.

f) Since the spring holder is constituted by two pieces of spring holders 61 and 62 arranged in the axial direction with a space and each of the spring holder pieces is respectively provided with the inner and outer cylindrical partition walls 61A, 62A and 61B, 62B, an inside and outside double arrangement structure therefor is realized which prevents interference between the return spring 63 and the spring 64 used for determining the initial opening degree, thereby, the springs are easily installed into the spring holder while achieving a collective arrangement of the parts thereof.

g) Further, because the return spring 63 is placed inside of the spring holder and the spring 64 used for determining the initial opening degree is placed outside thereof, the coil diameter accordingly the spring constant of the return spring 63 placed inside thereof can be selected smaller than those of the spring 64, thereby, the spring characteristic of the return spring 63 defined by spring loading as ordinate and throttle valve opening degree as abscissa can be flattened as much as possible, and resultantly, the load of the actuator for driving the throttle valve 24 is lightened.

However, alternatively, the return spring 63 can be placed outside space in the spring holder and the spring 64 used for determining the initial opening degree can be placed inside space thereof.

Now, a third embodiment is explained with reference to FIGS. 11A, 11B and 12.

Figure 11B:
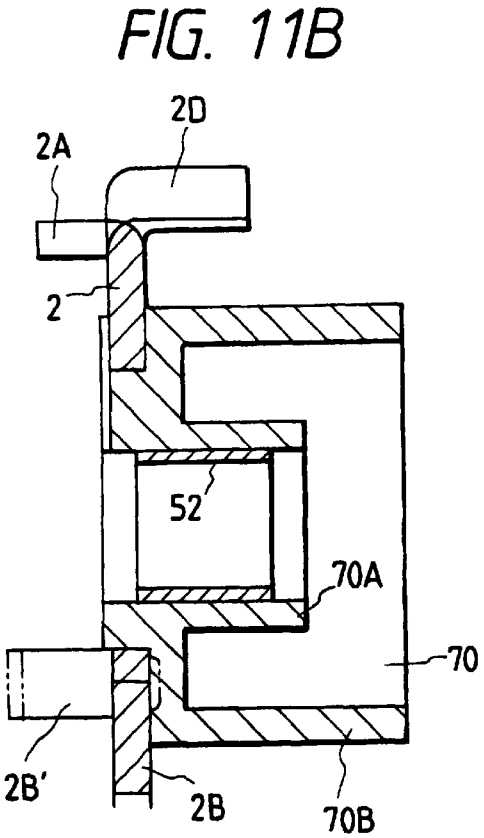
FIGS. 11A and 11B are cross sectional views of major portions of a third embodiment according to the present invention.
Figure 11A:
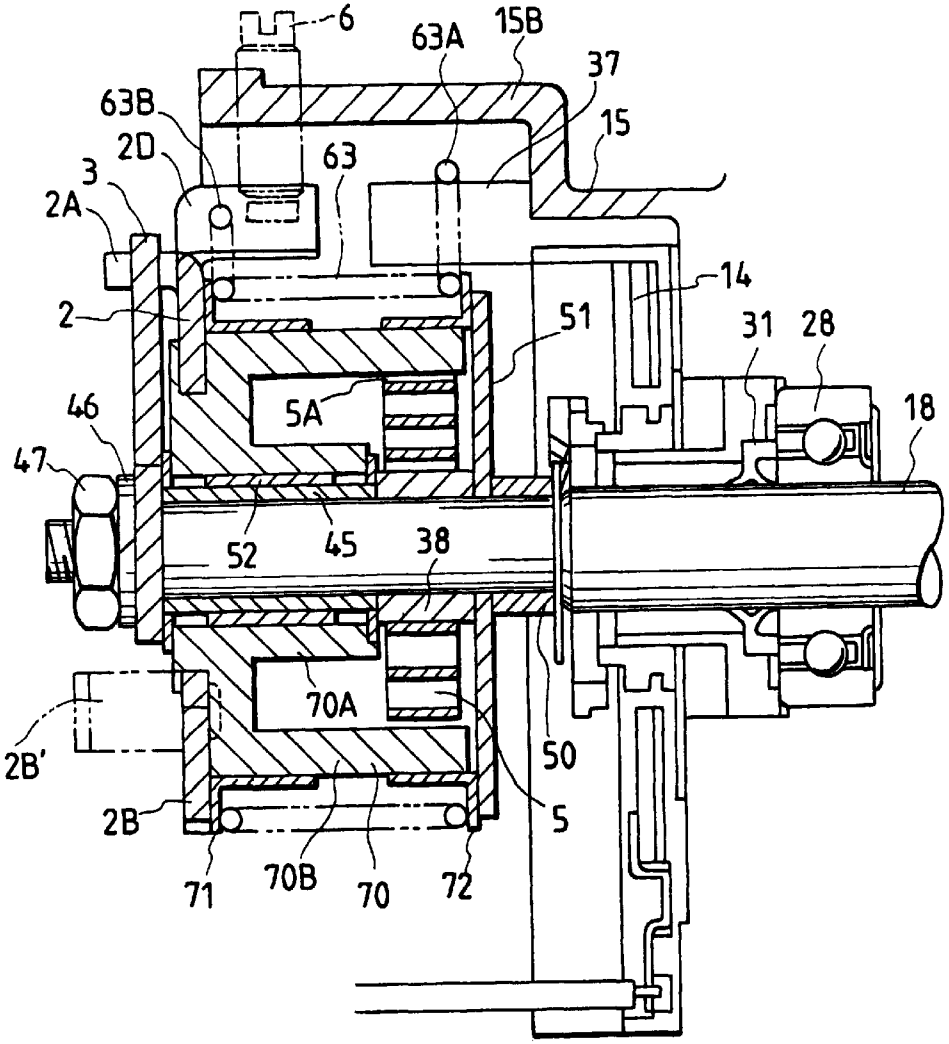
Figure 12:
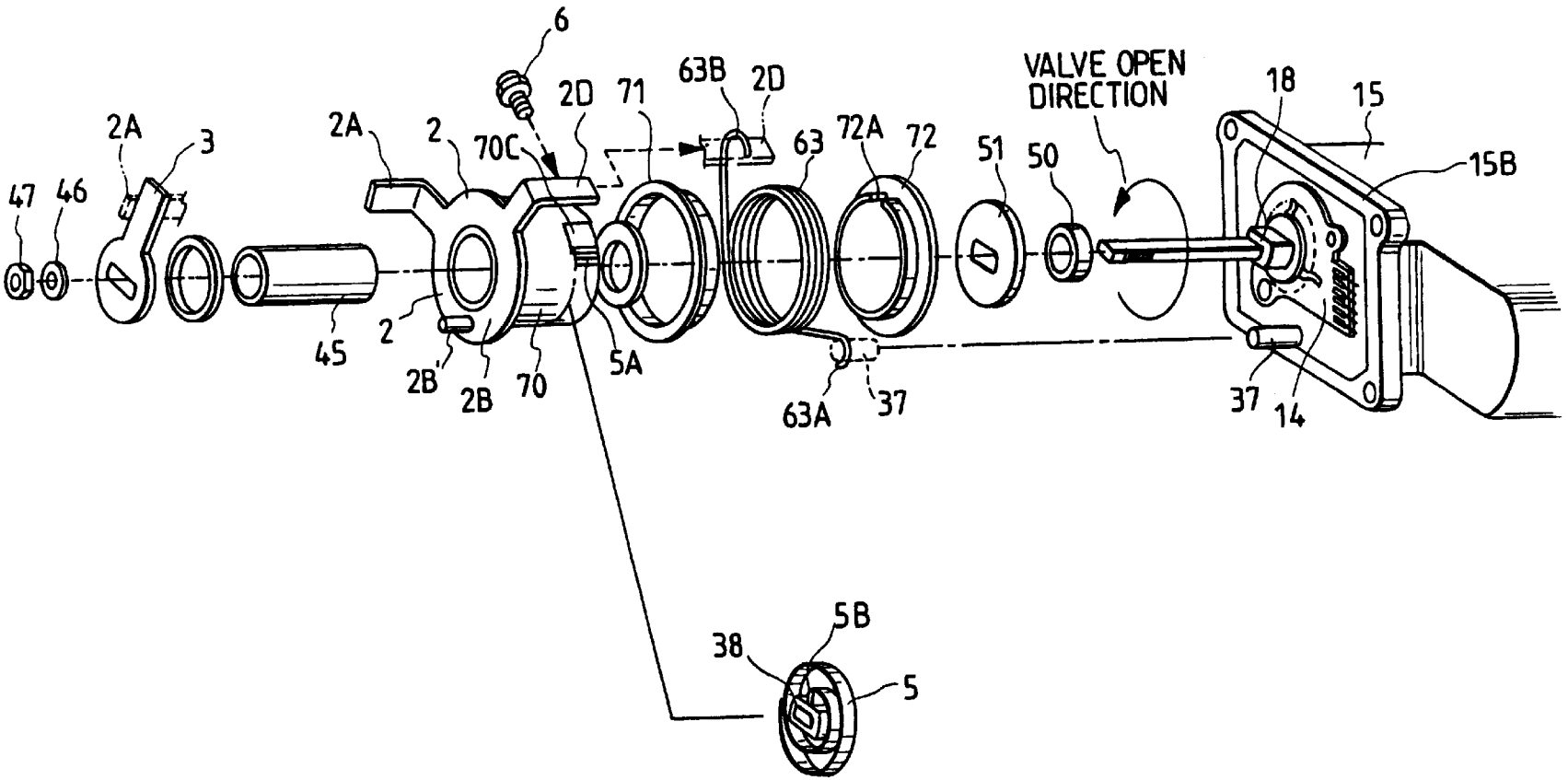
FIG. 12 is an exploded perspective view of a major portion of the third embodiment according to the present invention.

FIGS. 11A and 11B are cross sectional views of major portions of the third embodiment according to the present invention, and FIG. 12 is an exploded perspective view thereof. Although not illustrated in FIGS. 11A, 11B and 12, the arrangement and installation structure of the intake air passage 30 in the throttle body 15, the throttle valve 24, the reduction gear mechanism 9A, 9B, 10 and 11, the acceleration shaft 34 supported on the acceleration cover 22 and the levers 1 and 1' are substantially the same as those in the first and second embodiments.

In the present embodiment, one of the return spring 63 and the spring 5 used for determining the initial opening degree is a coil shaped torsion spring and the other is a sprial shaped torsion spring. Specifically, a coil shaped torsion spring is used for the return spring 63 and a spiral shaped torsion spring is used for the spring 5 used for determining the initial opening degree.

Further, in place of the sleeve 42 in the preceeding embodiments, a sleeve 70 with the lever (A) 2 is used.

The sleeve 70 is constituted by, in addition to the lever (A) 2, an inner cylindrical portion 70A which is fitted on the sleeve 45 so as to permit rotational movement thereto and an outer cylindrical portion 70B provided outside of the inner cylindrical portion 70A as illustrated in FIGS. 11A and 11B.

The length of the inner cylindrical portion 70A is cut shorter than that of the outer cylindrical portion 70B, and in the inner space formed in the sleeve 70 by cutting the inner cylindrical portion 70A the spring 5 used for determining opening degree is set on the throttle shaft 18 via the chip 38, the one end 5A of the spring 5 is fixed to a cut-out 70C provided at the sleeve 70 as illustrated in FIG. 12 and the other end 5B thereof is fixed to the chip 38.

In the outer cylindrical portion 70B of the sleeve 70, spring holders 71 and 72 arranged in axial direction with a space are fittedly installed.

The return spring 63 is supported by the spring holders 71 and 72, and one end 63A of the return spring 63 is fixed to the pin 37 on the throttle body 15 via a cut-out 72A provided at the spring holder 72 and the other end 63B thereof is fixed to the arm portion 2D of the lever (A) 2.

According to the present embodiment, in addition to the advantages obtained by the first embodiment the following advantage is obtained.

h) Even when different types of springs such as a coil shaped torsion spring and a spiral shaped torsion spring are used respectively for the return spring and the spring used for determining the initial opening degree, these two types of springs are collectively arranged in a single sleeve, thereby a compact throttle device is realized.

Figure 13:
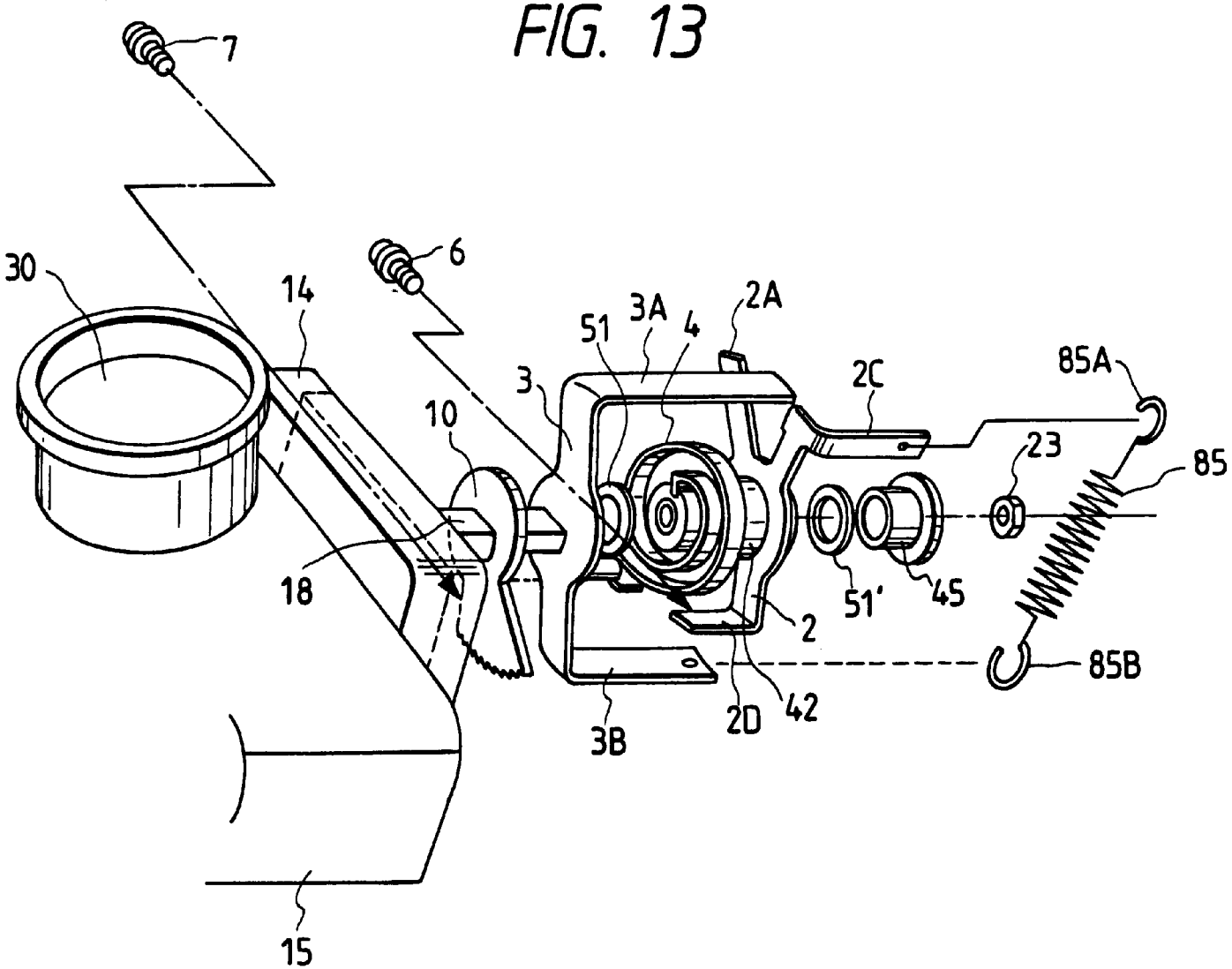
FIG. 13 is an exploded perspective view of a major portion of a fourth embodiment according to the present invention.
Figure 14A:
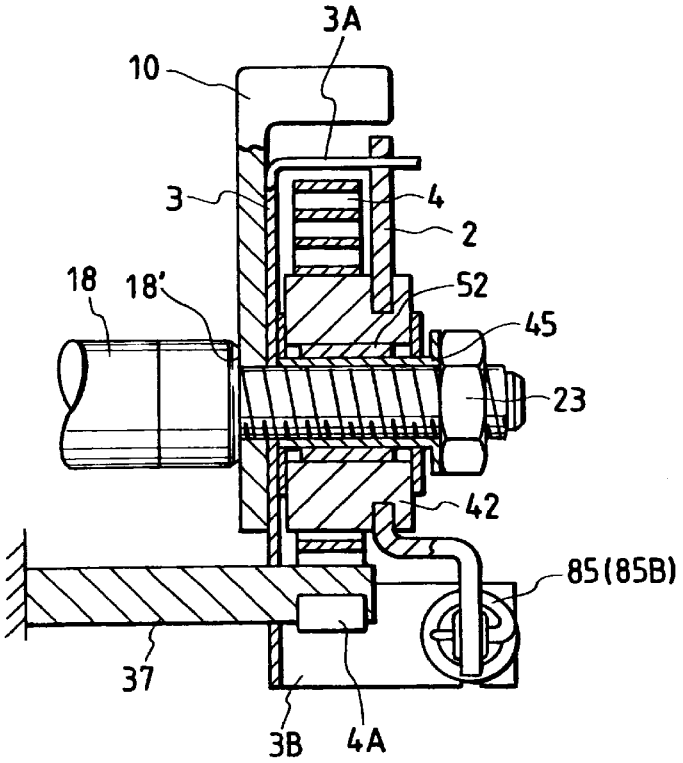
FIGS. 14 and 14B are cross sectional views of major portions of the fourth embodiment according to the present invention.
Figure 14B:
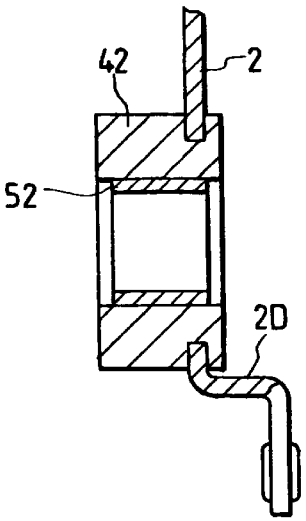

Now, a fourth embodiment according to the present invention is explained with reference to FIGS. 13, 14A and 14B, wherein FIG. 13 is an exploded perspective view of the fourth embodiment and FIGS. 14A and 14B are cross sectional views of major portions thereof.

In the present embodiment, one of the return spring and the spring used for determining the initial opening degree is a spiral shaped torsion spring and the other is a tension spring. In order to achieve a compact arrangement of the throttle device in the present embodiment the initial opening degree setting mechanism is arranged in the side of the reduction gear mechanism for the throttle valve driving system. In the drawings only the throttle gear 10 in the reduction gear mechanism is illustrated and the illustration of the gears 9A, 9B and 11 is omitted.

As illustrated in FIG. 13, in the present embodiment, from one end of the throttle shaft 18 at the side of the reduction gear mechanism the throttle gear 10, the lever (B) 3, the return spring 4, the sleeve 42 with the lever (A) 2, washer 51' and the sleeve 45 are successively inserted and clamped by the nut 23. A spiral spring is used for the return spring 4, and a tension spring 85 is used for the spring used for determining the initial opening degree which will be explained below.

In the same manner as in the preceeding embodiments, the sleeve 45 is secured on the throttle shaft 18 through a mutual action between the clamping by the nut 23 and the throttle shaft step 18' and around the outer circumference of the sleeve 45 the sleeve 42 is fitted so as to permit rotational movement thereof with respect to the sleeve 45 and the throttle shaft 18.

One end 4A of the return spring 4 is fixed to the pin 37 provided at the throttle body 15 as illustrated in FIG. 14A and the other end thereof is fixed to the sleeve 42, thereby, the return spring 4 urges the sleeve 42 and the lever (A) 2 in the direction of closing the throttle valve 24.

On the other hand, the arm portion 3A of the lever (B) 3 is disposed to be engageable with the arm portion 2A of the lever (A) 2, and the arm portion 3B thereof is fixed to one end 85B of the spring 85 used for determining the initial opening degree and the other end 85A of the spring 85 is fixed to the arm 2C of the lever (A) 2.

In the present embodiment like the preceeding embodiments, when the engine key switch is turned off, the initial opening degree setting mechanism operates to transmit the spring force of the return spring 4 via the engagement of the lever (A) 2 and the lever (B) 3 to the throttle shaft 18 to abut to the arm portion 2D of lever (A) 2 at the position of the initial opening degree, and with the spring force of the spring 85 used for determining the initial opening degree at this moment the initial opening degree of the throttle valve 24 is kept.

When the motor 12 serving as a throttle actuator is driven from this position in the closing direction against the tension force of the spring 85 used for determining the initial opening degree, and the fully close control of the throttle valve 24 is effected at the position of the adjusting screw 7.

The throttle sensor 14 is also arranged on a side wall face of the throttle body 15 at the side of the reduction gear mechanism.

In the present embodiment substantially the same advantages obtained in the preceeding embodiments are also obtained, in addition the following advantage is obtained.

i) The reduction gear mechanism for the throttle driving system and the initial opening degree setting mechanism can be collectively arranged. Further, the reduction gear mechanism and the return spring and the spring used for determining the initial opening degree are arranged closely along the throttle shaft 18, thereby mutually interfering torques in opposing directions can be reduced.

Figure 15:
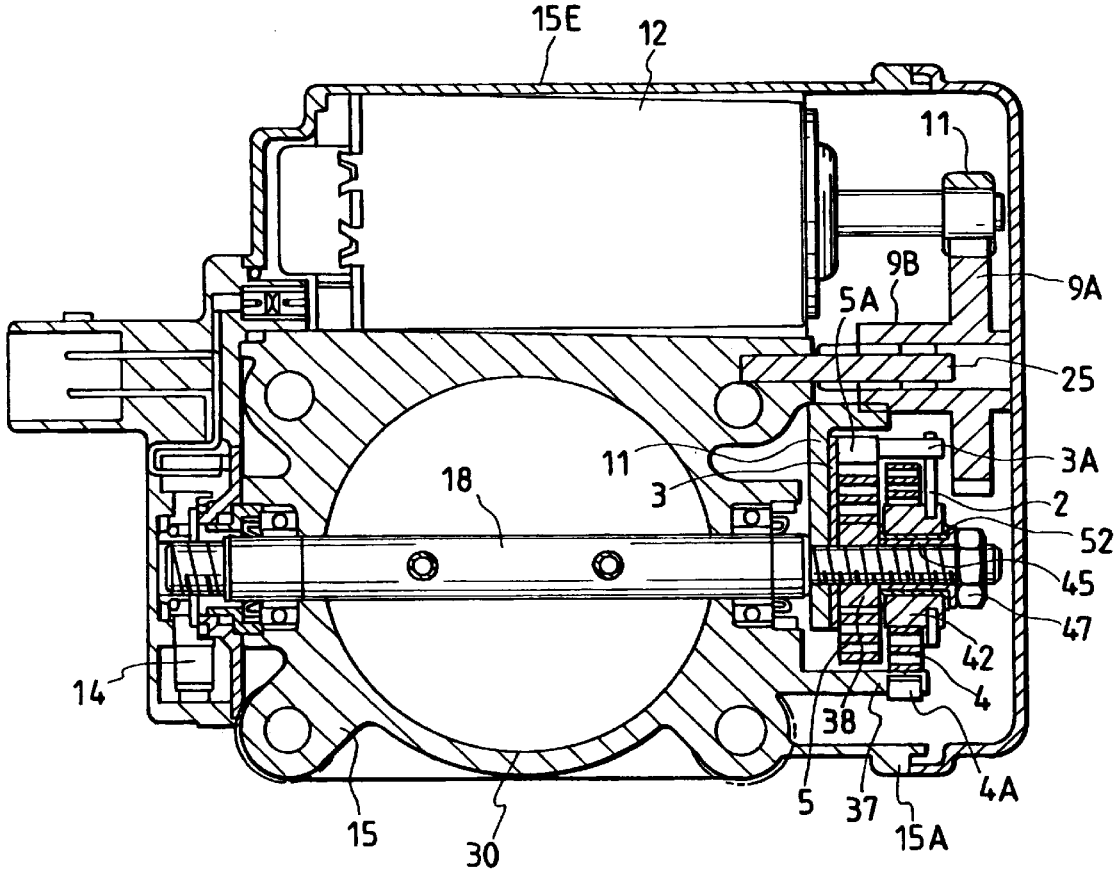
FIG. 15 is a cross sectional view of a fifth embodiment according to the present invention.

FIG. 15 is a cross sectional view illustrating a fifth embodiment according to the present invention. The present embodiment relates to a type of throttle device with no limp home mechanism, in that a fully electric type of throttle device, wherein the acceleration shaft, the acceleration lever and the acceleration sensor are separately disposed outside the throttle body, because the acceleration mechanism is used for generating signals relating to an accelerarion pedal position and is not directly related to the open and close operation of the throttle valve.

In the present embodiment, the initial opening degree setting mechanism is also arranged at the side of the reduction gear mechanism for the throttle driving system located at one end of the throttle shaft 18. The return spring 4 and the spring 5 used for determining the initial opening degree are installed in substantially the same manner as in the first embodiment. At one end of the throttle shaft 18, the throttle gear 11, the lever (B) 3 and the chip 38 with the spring 5 used for determining the initial opening degree are successively arranged inmovably and the return spring 4 and the sleeve 42 with the lever (A) 2 are fitted via the sleeve 45, then the assembly is clamped by the nut 47 so as to permit rotational movement of the sleeve 42 over the sleeve 45.

One end 4A of the return spring 4 is fixed to the pin 37 on the throttle body 15 and the other end thereof is fixed to the sleeve 42.

The arm portion 3A of the lever (B) 3 is disposed to be engageable with the lever (A) 2 beyond the spring 5 used for determining the initial opening degree and the return spring 4.

One end 5A of the spring 5 used for determining the initial opening degree is fixed to the arm portion 3A of the lever (B) 3 and the other end thereof is fixed to the chip 38. In the present embodiment, the illustration of the screw 6 for adjusting the initial opening degree and the screw 7 for adjusting the fully closed position is omitted, however, these screws are arranged in the casing portion 15A formed integrally with the throttle body 15. The principle of the initial opening degree setting operation according to the present embodiment is substantially the same as in the preceeding embodiments, the explanation thereof is omitted.

In the present embodiment advantages except for those relating to the limp home function obtained in the preceeding embodiments are likely obtained, in addition the following advantage is obtained.

j) In the present embodiment, the throttle shaft torque characteristics T1 and T2, in other words P1 and P2 characteristics at the position of the stopper used for setting the initial opening degree are set in the following inequations.

$$T1 \geqq Mf \times Ge + Vf$$

$$T2 \leqq Mf \times Ge + Vf$$

wherein, Mf; friction torque when the motor is standstill, Ge; reduction gear ratio, Vf; necessary torque to be applied on the throttle shaft so as to open the throttle valve.

Figure 16:
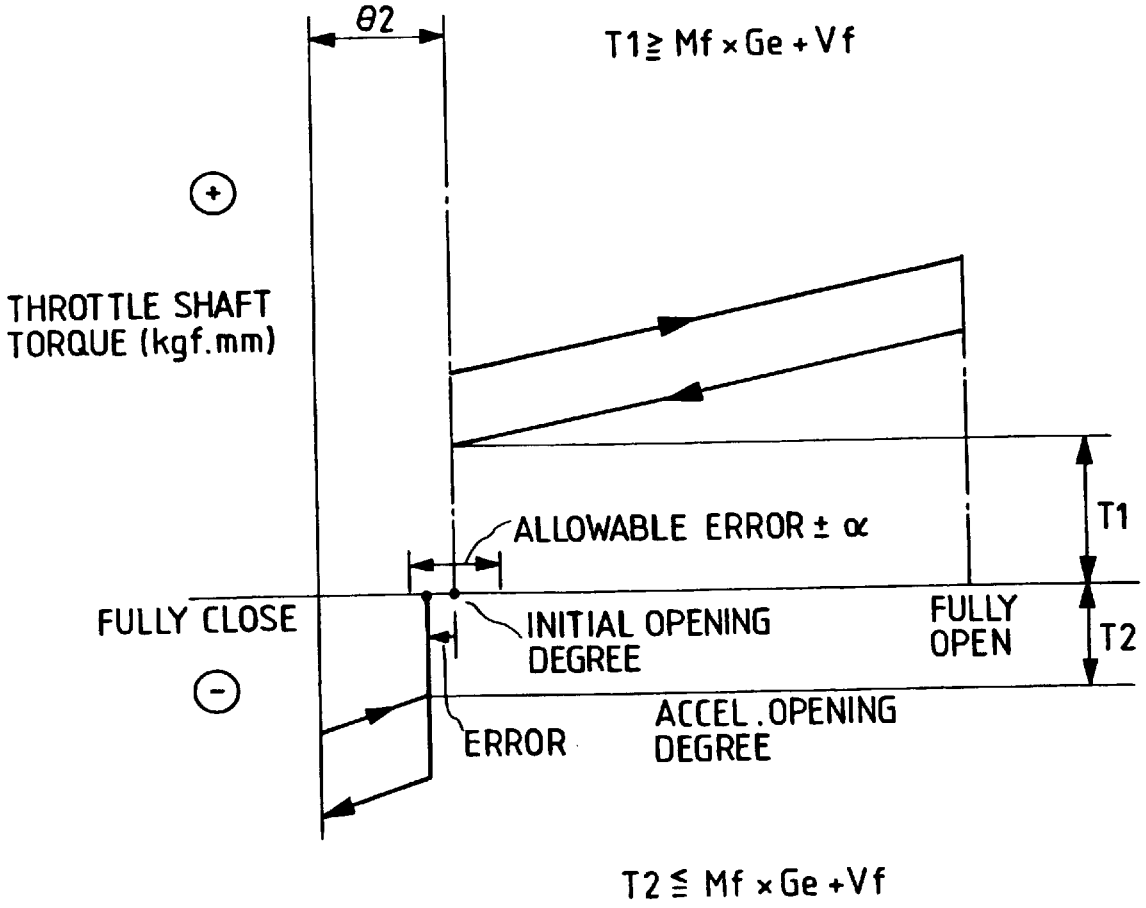
FIG. 16 is a view for explaining an example of throttle shaft torque charactristics used in the fifth embodiment according to the present invention.

When setting the throttle shaft torque characteristics T1 and T2 according to the above inequations, the throttle shaft torque characteristics are minimized and the throttle shaft torque step T1−(−T2) near the position of the throttle initial opening degree can be reduced, thereby, the throttle drive control can be stabilized. Further, in case when $T2<Mf\times Ge+Vf$, T2 is slightly sacrificed at the position of the initial opening degree as illustrated in FIG. 16 and a resident error is generated at the position of the throttle initial opening degree. However, in spite of this resident error, if an air flow rate necessary for a combustion required from the vehicle side during a cold eliminate start is ensured, an intended perpose for the initial opening degree is satisfied.

k) Further, in the present embodiment, the reduction gear mechanism and the initial opening degree setting mechanism are arranged at one side with reference to the throttle body 15, and the throttle position sensor is arranged at the other side.

A mechanism having a mechanical sliding portion, for example a sliding portion of intermetallic members, such as the reduction gear mechanism is likely to generate weared powders. According to the above constitutional structure, the reduction gear mechanism and the throttle position sensor are disposed in a spaced apart relationship via the throttle body, because of the above spaced arrangement structure an inclusion of the weared powders into the throttle position sensor is prevented and a performance degradation of the throttle position sensor is also prevented.

Further, since the reduction gear mechanism as well as the throttle initial opening degree setting mechanism are collectively arranged inside the casing near the motor location, a collective arrangedment of the parts thereof is achieved as well as the down sizing of the entire throttle device is also achieved. Moreover, the throttle position sensor can be designed to be disposed near the center of the throttle body as much as possible, resultantly, influences due to deflection and bending of the throttle shaft is eliminated and a variation of output characteristic of the throttle position sensor can be limited.

According to the present invention, parts belonging to a throttle valve initial opening degree setting mechanism and, if required, parts beloging to other mechanisms including such as a limp home mechanism are collectively and rationally arranged, while improving mounting characteristics of these mechanisms, and further, a reduction of frictions inherent to the mechanisms, and an improvement in characteristic of urging means, for example an improvement in spring characteristics of such as the return spring in comparison with conventional devices are achieved, thereby a driving load for a throttle valve actuator is reduced, and a throttle valve control operation is stabilized.

What is claimed is:

1. A throttle valve control device for an internal combustion engine of which opening angle is controlled by a motor comprising:

a spring which provides a predetermined opening angle when no electric power is supplied to the motor, and wherein the characteristic of the throttle valve is determined in such a manner that in a region between the opening angle covered by the spring and a specific opening angle to a further open side from the region covered by the spring an opening angle degree of the throttle valve with respect to a unit depression amount of an acceleration pedal is selected smaller than that for an opening angle exceeding the predetermined opening angle.

* * * * *